US011515075B2

(12) United States Patent
Kawasaki et al.

(10) Patent No.: US 11,515,075 B2
(45) Date of Patent: Nov. 29, 2022

(54) COIL DEVICE

(71) Applicant: TDK CORPORATION, Tokyo (JP)

(72) Inventors: Yoshihiro Kawasaki, Tokyo (JP); Munehito Nishimura, Tokyo (JP); Aoi Tokiwa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 1044 days.

(21) Appl. No.: 16/198,300

(22) Filed: Nov. 21, 2018

(65) Prior Publication Data

US 2019/0189337 A1 Jun. 20, 2019

(30) Foreign Application Priority Data

Dec. 18, 2017 (JP) ..... JP2017-242244

(51) Int. Cl.

| | |
|---|---|
| ***H01F 27/28*** | (2006.01) |
| ***H01F 41/069*** | (2016.01) |
| ***H01F 17/04*** | (2006.01) |
| ***H01F 27/24*** | (2006.01) |
| ***H01F 41/076*** | (2016.01) |
| ***H01F 27/29*** | (2006.01) |

(52) U.S. Cl.

CPC ..... *H01F 27/2828* (2013.01); *H01F 17/045* (2013.01); *H01F 27/24* (2013.01); *H01F 27/29* (2013.01); *H01F 41/069* (2016.01); *H01F 41/076* (2016.01)

(58) Field of Classification Search

CPC ..... H01F 41/069; H01F 17/045; H01F 27/24

See application file for complete search history.

(56) References Cited

U.S. PATENT DOCUMENTS

| | | | | |
|---|---|---|---|---|
| 6,344,784 | B1 | 2/2002 | Murata et al. | |
| 6,472,969 | B1 * | 10/2002 | Hanato | H01F 17/045 336/200 |
| 2004/0263285 | A1 * | 12/2004 | Suzuki | H01F 41/082 333/185 |
| 2005/0052267 | A1 * | 3/2005 | Singu | H01F 27/292 336/83 |
| 2006/0170526 | A1 * | 8/2006 | Okumura | H01F 27/292 336/208 |
| 2008/0106363 | A1 * | 5/2008 | Liu | H01F 38/10 336/192 |
| 2015/0042434 | A1 * | 2/2015 | Bando | B65H 75/06 242/613.3 |

(Continued)

FOREIGN PATENT DOCUMENTS

| | | |
|---|---|---|
| CN | 1822256 A | 8/2006 |
| JP | 2008-091359 A | 4/2008 |

(Continued)

*Primary Examiner* — Mang Tin Bik Lian
*Assistant Examiner* — Malcolm Barnes
(74) *Attorney, Agent, or Firm* — Oliff PLC

(57) ABSTRACT

A coil device includes a core and a coil portion. The core includes a winding core part and a flange part disposed at one end of the winding core part in an axial direction thereof. The coil portion is formed by winding a first wire and a second wire around the winding core part. The flange part includes first and second grooves passed by a leading part of the first wire or the second wire. The first groove extends toward an outside of the flange part. The second groove extends toward the outside of the flange part at an angle differing from that of the first groove.

15 Claims, 16 Drawing Sheets

(56) References Cited

U.S. PATENT DOCUMENTS

| | | | | |
|---|---|---|---|---|
| 2016/0240305 | A1* | 8/2016 | Igarashi | H01F 27/2828 |
| 2016/0365191 | A1* | 12/2016 | Horie | H01F 27/2823 |
| 2017/0025212 | A1* | 1/2017 | Jerez | H01F 41/07 |
| 2017/0062122 | A1* | 3/2017 | Kanbe | H01F 27/2823 |

FOREIGN PATENT DOCUMENTS

| | | | | |
|---|---|---|---|---|
| JP | 2009-147158 | A | | 7/2009 |
| JP | 2009147158 | A | * | 7/2009 |
| JP | 2017-005079 | A | | 1/2017 |

* cited by examiner

COIL DEVICE

BACKGROUND OF THE INVENTION

The present invention relates to a coil device used as, for example, an inductor.

Patent Document 1 discloses a coil device including a core with flange parts arranged on ends of a winding core part in an axial direction thereof and a coil portion formed by winding two wires around the winding core part. In the coil device of Patent Document 1, however, leading parts of the wires pass through corners of the approximately perpendicular flange parts and bend sharply, which easily breaks insulation covers of the leading parts of the wires at the corners of the flange parts and may cause short circuit failure with the core. In the coil device of Patent Document 1, the leading parts of the wires cross each other around a boundary between each flange part and the winding core part, and short circuit failure may occur between the wires.

Patent Document 1: JP200891359 (A)

BRIEF SUMMARY OF INVENTION

The present invention has been achieved under such circumstances. It is an object of the invention to provide a coil device capable of preventing short circuit failure.

To achieve the above object, a coil device according to the present invention includes:

a core including a winding core part and a flange part disposed at one end of the winding core part in an axial direction thereof; and a coil portion formed by winding a first wire and a second wire around the winding core part, wherein the flange part includes first and second grooves passed by a leading part of the first wire or the second wire, the first groove extends toward an outside of the flange part, and the second groove extends toward the outside of the flange part at an angle differing from that of the first groove.

To achieve the above object, a core according to the present invention includes:

a winding core part; and a flange part disposed at one end of the winding core part in an axial direction thereof, wherein the flange part includes first and second grooves, the first groove extends toward an outside of the flange part, and the second groove extends toward the outside of the flange part at an angle differing from that of the first groove.

In the coil device and the core according to the present embodiment, the flange part includes the first and second grooves passed by either of the leading parts of the first and second wires. Unlike the prior arts, the leading parts of the first and second wires are thereby drawn to terminal electrodes via the first groove or the second groove. Thus, insulation covers of the first and second wires are less likely to be broken, and a short circuit failure between the first and second wires and the core can be prevented from occurring.

In the coil device according to the present embodiment, the first groove extends toward the outside of the flange part, and the second groove extends toward the outside of the flange part at an angle differing from that of the first flange part. Thus, a leading part of a wire passing through the first groove and a leading part of a wire passing through the second groove are drawn in different directions, and the leading part of the first wire and the leading part of the second wire can sufficiently be separated from each other. It is thereby possible to prevent the leading parts of the wires from crossing each other in the boundary between the flange part and the winding core part and to prevent generation of short circuit failure between the wires.

In the coil device according to the present embodiment, each wire is drawn along the groove in drawing each of the leading parts of the first and second wires to the terminal electrode, and a sliding movement of the wires is limited by the grooves. Thus, the insulation covers of the wires are less likely to be broken, and a short circuit failure between the wires and the core can be prevented from occurring.

Preferably, at least an extended line of a center axis of the second groove among extended lines of center axes of the first and second grooves crosses an end surface of the flange part. In this structure, at least the second groove extends toward the outer end surface of the flange part, and the leading parts of the wires can be drawn toward the outer end surface of the flange part. Thus, after the wires are connected to the terminal electrodes, the wires are drawn to the outside of the outer end surface of the flange part and can be cut at the outside of the flange part by, for example, moving a cutting device along the outer end surface of the flange part. It is thereby possible to prevent the cutting device from breaking the flange part at the time of cutting the wires.

Preferably, the first and second grooves become wider toward the outside of the flange part. In this structure, the first and second grooves become wider as they approach the terminal electrodes, and the first and second wires can easily be inserted into the grooves respectively at the time of drawing the leading parts of the wires to the terminal electrodes or at the beginning of winding the wires.

Preferably, the flange part includes a wall part dividing the first and second grooves. In this structure, the first wire passing through the first groove and the second wire passing through the second groove are less likely to contact with each other, and a short circuit failure between the wires can effectively be prevented from occurring.

Preferably, the coil device according to the present invention further includes a step surface formed around a boundary between the flange part and the winding core part, and a first start tip of the first groove and a second start tip of the second groove are arranged at different positions along a periphery of the step surface. When the step surface as mentioned above is formed, the first and second wires are led to the middle of each of the grooves without contacting with the step surface of the flange part around the first and second start tips and do not bend sharply, and the insulation covers of the first and second wires can effectively be prevented from being broken.

A space between each of the wires and the flange part is formed around the boundary between the flange part and the winding core part, and the leading part of the first wire can be wired in the air to the front of the first end tip of the first groove and is easily drawn to the terminal electrode via the first groove. Likewise, the leading part of the second wire can be wired in the air from above the step surface to the front of the second end tip of the second groove and is easily drawn to the terminal electrode via the second groove.

Preferably, a distance between a first start tip of the first groove and an end surface of the flange part and a distance between a second start tip of the second groove and the end surface of the flange part are different from each other. In this structure, the first start tip of the first groove and the second start tip of the second groove are arranged separately on the step surface. It is thereby possible to sufficiently separate a wire passing through the first start tip and a wire passing through the second start tip, to prevent the leading parts of the wires from crossing each other around the boundary between the flange part and the winding core part (i.e., step surface), and to effectively prevent generation of short circuit failure between the wires.

Preferably, a distance between a first end tip of the first groove and an end surface of the flange part and a distance between a second end tip of the second groove and the end surface of the flange part are substantially equal to each other. In this structure, a wire passing through the first end tip of the first groove and a wire passing through the second end tip of the second groove are arranged at positions having approximately the same distance from the outer end surface of the flange part. Thus, the leading parts of the wires can be connected to the terminal electrodes by, for example, being pushed together by a heater for thermocompression.

Preferably, an outer shape of the flange part seen from a front surface of the core and an outer shape of the flange part seen from a back surface of the core correspond to each other in reversing the core. In this structure, the terminal electrodes can be formed on both of the top surface and the bottom surface of the flange part.

The coil portion may include a first layer formed by the first wire and a second layer disposed on an outer circumference of the first layer and formed by the second wire.

Preferably, the coil device according to the present invention further includes an opposite flange part disposed at the other end of the winding core part and including a third groove corresponding to the first groove and a fourth groove corresponding to the second groove, wherein one leading part of the first wire passes through the first groove formed in the flange part disposed at one end of the winding core part in the axial direction, the other leading part of the first wire passes through the fourth groove formed in the opposite flange part disposed at the other end of the winding core part in the axial direction, one leading part of the second wire passes through the second groove formed in the flange part disposed at one end of the winding core part in the axial direction, and the other leading part of the second wire passes through the third groove formed in the opposite flange part disposed at the other end of the winding core part in the axial direction.

In this structure, both of the first wire and the second wire are wound around the winding core part, and coils of the first wire and the second wire having the same wire length can be formed.

Preferably, the coil device according to the present invention further includes a first terminal electrode formed on a surface of the flange part and partially entering the first groove and a second terminal electrode formed on the surface of the flange part and partially entering the second groove. In this structure, the first terminal electrode and the second terminal electrode can also be formed on a part other than the outermost surface of the flange part and can have a sufficient connection area with the first wire and the second wire.

Preferably, a leading part of each of the first and second wires is connected to the first or second terminal electrode so as to be close to an end surface of the flange part. In this structure, the wires are easily connected to the terminal electrodes, easily drawn to the outside of the outer end surface of the flange part, and easily cut at the outside of the flange part.

DETAILED DESCRIPTION OF INVENTION

Hereinafter, the present invention is explained based on embodiments shown in the figures.

First Embodiment

Figure 1A:
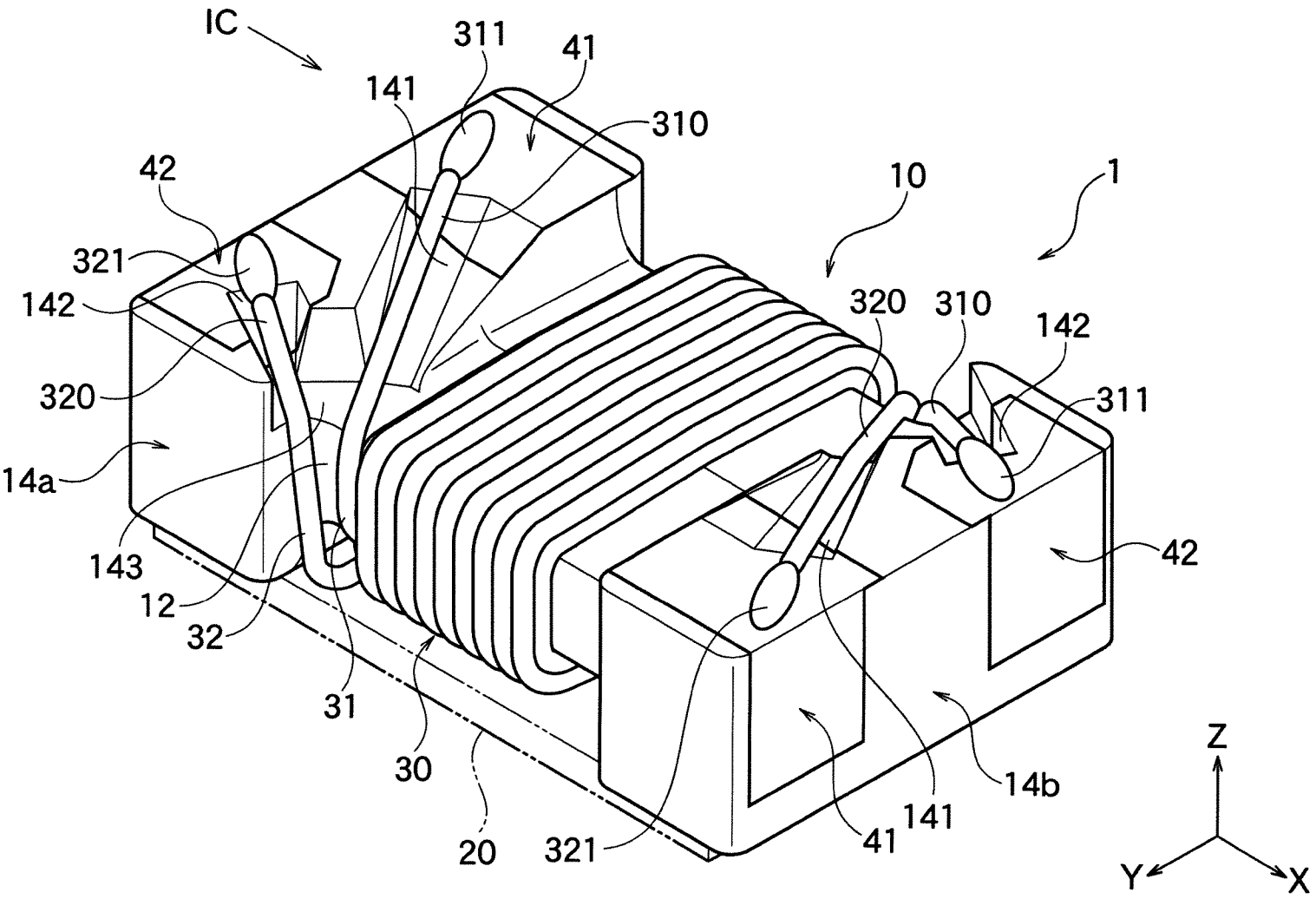
FIG. 1A is a whole perspective view of a coil device according to an embodiment of the present invention.

As shown in FIG. 1A, a coil device 1 according to an embodiment of the present invention includes a drum core 10 and a coil portion 30 wound around a winding core part 12 of the drum core 10.

In the following explanation, the X-axis is a parallel direction to a winding axis of the winding core part 12 of the drum core 10 within a parallel plane to a mount surface where the coil device 1 is mounted, the Y-axis is a perpendicular direction to the X-axis within a parallel plane to the mount surface, and the Z-axis is a normal direction to the mount surface.

The drum core 10 includes the winding core part 12 and a pair of flange parts 14*a* and 14*b* arranged on both ends of the winding core part 12 in the X-axis direction. The flange part (opposite flange part) 14*b* is opposite to the flange part 14*a*. In the following explanation, the flange parts 14*a* and 14*b* are generically referred to as "flange part(s) 14" if there is no need to distinguish them.

The winding core part 12 has a winding axis in the X-axis direction and has a substantially hexagonal cross-sectional shape elongated in the Y-axis direction. The flange parts 14 have the same shape, but may have different shapes. Incidentally, the winding core part 12 has a substantially hexagonal cross-sectional shape in the present embodiment, but may have any cross-sectional shape, such as rectangle, circle, and substantially octagon.

As shown in FIG. 1A, a first wire 31 and a second wire 32 are wound around the winding core part 12 by double layers and form the coil portion 30. In the illustrated example, the coil portion 30 includes a first layer formed by the first wire 31 and a second layer disposed on the outer circumference of the first layer and formed by the second wire 32. Incidentally, a pair of wires 31 and 32 may be wound around the winding core part 12 by single layer.

For example, the wires 31 and 32 are a covered wire formed by covering a wire core of good conductor with an insulation cover film. In the present embodiment, the conductor portion of the wires 31 and 32 have the same cross-sectional area, but may have different cross-sectional areas. The coil portion 30 may be formed by winding one wire by one or more layers or may be formed by winding three or more wires by one or more layers.

In the present embodiment, the wires 31 and 32 have approximately the same winding number, but may have different winding numbers depending on purposes. Incidentally, "the wires 31 and 32 have approximately the same winding number" means that a ratio of winding number of the wires 31 and 32 is 0.75 to 1/0.75, preferably 1.

Figure 1B:
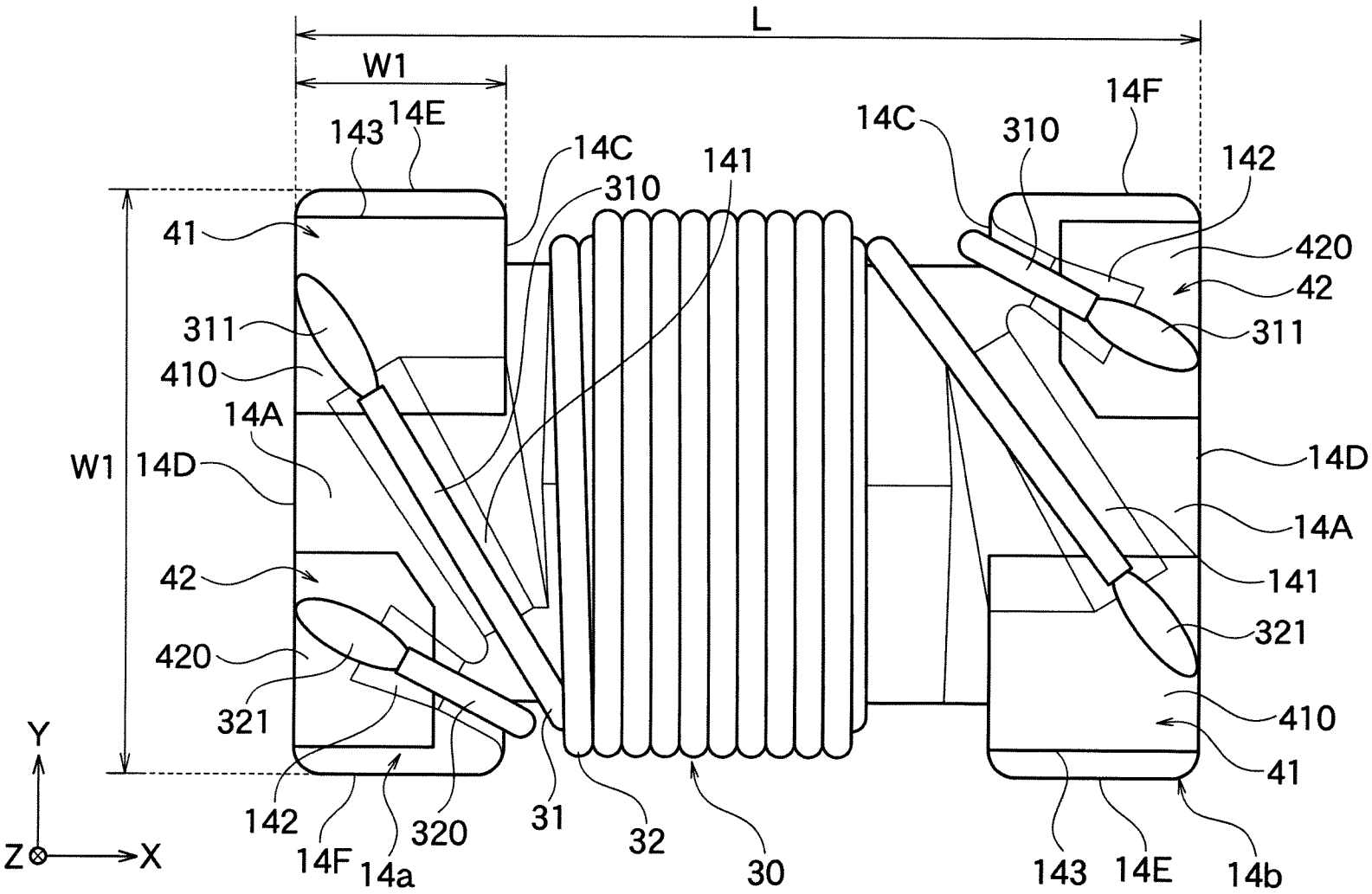
FIG. 1B is a plane view of the coil device shown in FIG. 1A.

The flange parts 14 have a roughly cuboid outer shape being long in the Y-axis direction and are arranged approximately parallel to each other with a predetermined distance in the X-axis direction. As shown in FIG. 1B, when the flange parts 14 are seen from the mount surface (the upper side in the Z-axis in the present embodiment), each of the flange parts 14 is formed to have four round corners. Incidentally, the flange parts 14 may have any cross-sectional shape (Y-Z cross section), such as circle and approximately octagon.

As shown in FIG. 1B, each of the flange parts 14 includes a top surface 14A, a bottom surface 14B, an inner end surface 14C, an outer end surface 14D, a first side surface 14E, and a second side surface 14F. The top surface 14A is a surface of the flange part 14 on the upper side. The bottom surface 14B is an opposite surface to the top surface 14A. The inner end surface 14C is a surface near the winding core part 12. The outer end surface 14D is an opposite surface to the inner end surface 14C. The first side surface 14E is a surface that is perpendicular to the top surface 14A and the inner end surface 14C and is near a first terminal electrode 41 mentioned below. The second side surface 14F is a surface that is perpendicular to the top surface 14A and the inner end surface 14C and is near a second terminal electrode 42 mentioned below.

In the present embodiment, the top surface 14A is a mount surface (ground plane) where the coil device 1 is mounted on a circuit board or so. In the illustrated example, the first side surface 14E of one flange part 14 and the second side surface 14F of the other flange part 14 are flush with each other, but may not be flush with each other in the Y-axis direction.

Figure 1C:
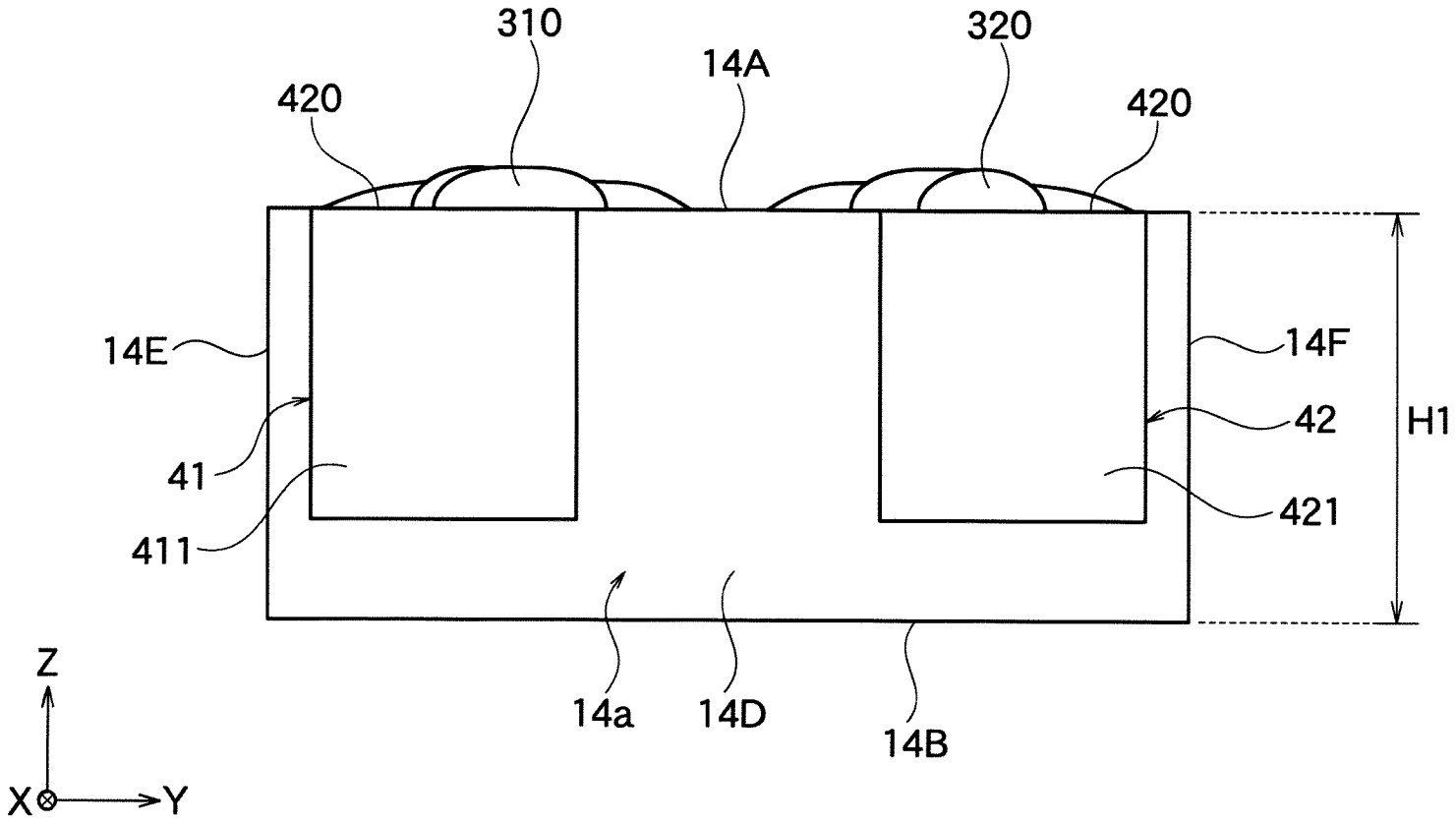
FIG. 1C is a side view of the coil device shown in FIG. 1A seen from IC.

The first terminal electrode 41 is formed on the top surface 14A (mount surface) of the flange part 14. As shown in FIG. 1B and FIG. 1C, the first terminal electrode 41 is formed by a first top-surface electrode part 410 and a first side-surface electrode part 411, and these electrode parts are connected electrically. For more detail, the first top-surface electrode part 410 is a parallel surface to the XY plane and is formed at one end of the top surface 14A of the flange part 14 in the Y-axis direction.

The first top-surface electrode part 410 partially enters a part of a first groove 141 mentioned below. The first side-surface electrode part 411 is a parallel surface to the YZ plane and is formed on the end surface 14D of the flange part 14. Since the first side-surface electrode part 411 is formed on the flange part 14, a solder fillet can sufficiently be formed on the first terminal electrode 41.

A first wire-connection part 311 (a connection part with a leading part 310 of the first wire 31) is formed on the first top-surface electrode part 410 of the flange part 14*a*. Likewise, a second wire-connection part 321 (a connection part with a leading part 320 of the second wire 32) is formed on the first top-surface electrode part 410 of the flange part 14*b*. The first wire-connection part 311 is formed by thermocompression bonding of the leading part 310 against the first top-surface electrode part 410. The second wire-connection part 321 is formed by thermocompression bonding of the leading part 320 against the first top-surface electrode part 410. In the present embodiment, the leading part 310 of the first wire 31 is connected to the first top-surface electrode part 410 so as to be close to the end surface 14D of the flange part 14*a*, and the leading part 320 of the second wire 32 is connected to the first top-surface electrode part 410 so as to be close to the end surface 14D of the flange part 14*b*.

In the present embodiment, the first top-surface electrode part 410 also functions as a mount part facing and connected to a surface of a circuit board (not shown). For more detail, an area of the first top-surface electrode part 410 where the first wire-connection part 311 is not formed functions as a good solder joint surface with an electrode (land) of the circuit board.

The second terminal electrode 42 is formed on the top surface 14A (mount surface) of the flange part 14 with a predetermined distance (separately) against the first terminal electrode 41 in the Y-axis direction. Incidentally, the first terminal electrode 41 and the second terminal electrode 42 may be arranged with any distance as long as they are insulated.

In the present embodiment, the second terminal electrode 42 is formed by a second top-surface electrode part 420 and a second side-surface electrode part 421, and these electrode parts are connected electrically. For more detail, the second top-surface electrode part 420 is a parallel surface to the XY plane and is formed on the other end (opposite to the first top-surface electrode part 410) of the top surface 14A of the flange part 14 in the Y-axis direction.

The second top-surface electrode part 420 partially enters a part of a second groove 142 mentioned below, but does not partially enter the first groove 141 and keeps away from the first groove 141.

The second side-surface electrode part 421 is a parallel surface to the YZ plane and is formed on the end surface 14D of the flange part 14. Since the second side-surface electrode part 421 is formed on the flange part 14, a sufficient solder fillet can sufficiently be formed on the second terminal electrode 42.

A second wire-connection part 321 (a connection part with a leading part 320 of the second wire 32) is formed on the second top-surface electrode part 420 of the flange part 14*a*. Likewise, a first wire-connection part 311 (a connection part with a leading part 310 of the first wire 31) is formed on the second top-surface electrode part 420 of the flange part 14*b*. The second wire-connection part 321 is formed by thermocompression bonding of the leading part 320 against the second top-surface electrode part 420. The first wire-connection part 311 is formed by thermocompression bonding of the leading part 310 against the second top-surface electrode part 420. In the present embodiment, the leading part 310 of the first wire 31 is connected to the second top-surface electrode part 420 so as to be close to the end surface 14D of the flange part 14*b*, and the leading part 320 of the second wire 32 is connected to the second top-surface electrode part 420 so as to be close to the end surface 14D of the flange part 14*a*.

In the present embodiment, the second top-surface electrode part 420 also functions as a mount part facing and connected to a surface of a circuit board (not shown). For more detail, an area of the second top-surface electrode part 420 where the second wire-connection part 321 is not formed functions as a good solder joint surface with an electrode (land) of the circuit board.

Figure 2A:
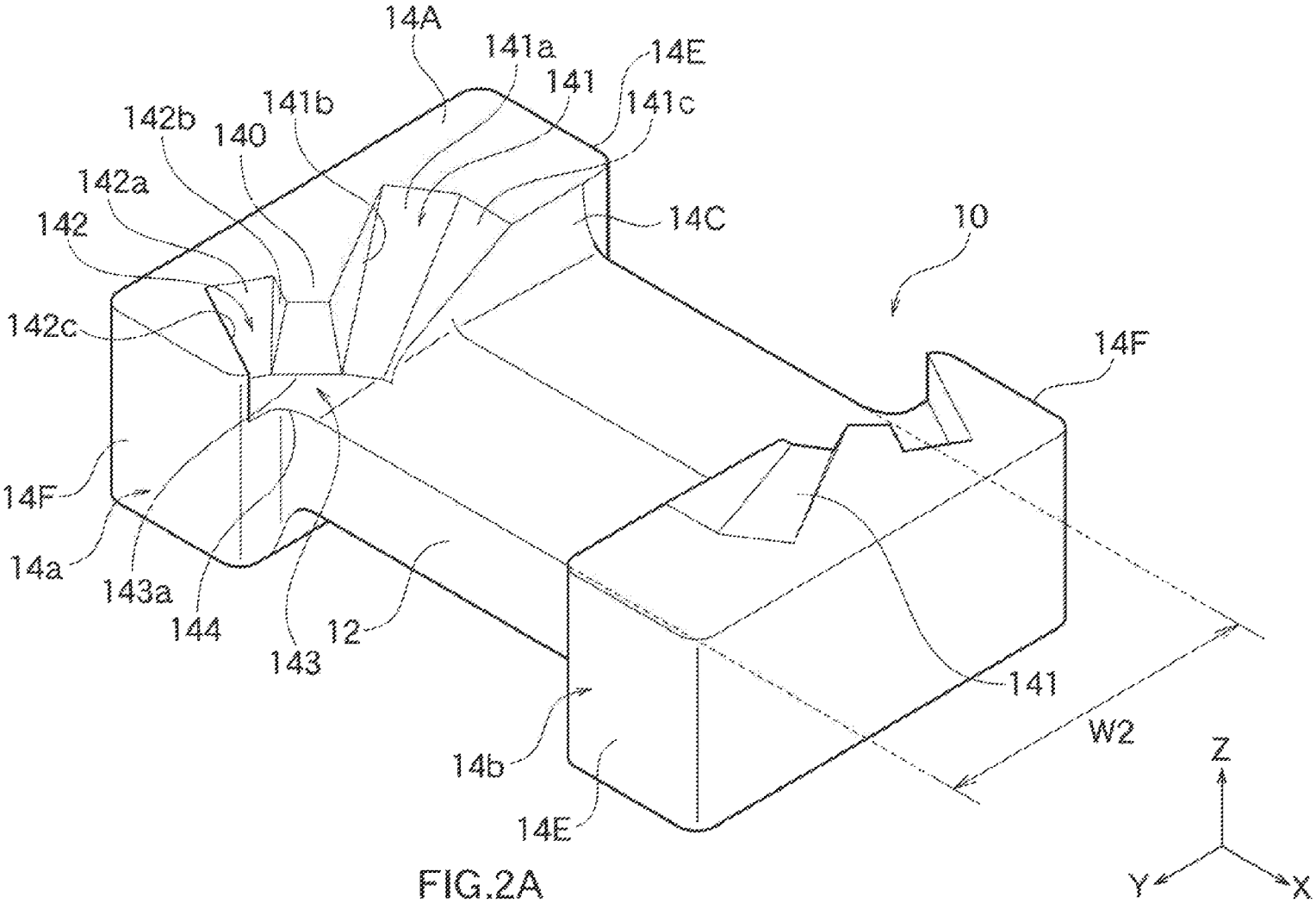
FIG. 2A is a perspective view illustrating a step of manufacturing the coil device shown in FIG. 1A.

As shown in FIG. 2A, a step surface 143 having a substantially plane shape is formed around a boundary between the winding core part 12 and the inner end surface 14C of the flange part 14. The step surface 143 is formed near the second terminal electrode 42 of the flange part 14 and is positioned slightly lower than the top surface of the winding core part 12 in the Z-axis direction.

A curved part 144 of R-plane is formed at a corner between the inner end surface 14C of the flange part 14 and a side surface of the winding core part 12. As shown in FIG. 1A, the curved part 144 functions as an engagement part where the leading part 320 of the second wire 32 is engaged.

The flange part 14 includes the first groove 141 and the second groove 142. The first groove 141 formed in the flange part 14*a* and the first groove 141 formed in the flange part 14*b* (also referred to as a third groove) have the same structure. The second groove 142 formed in the flange part 14*a* and the second groove 142 formed in the flange part 14*b* (also referred to as a fourth groove) have the same structure. In the present embodiment, the grooves 141 and 142 formed in the flange part 14*a* and the grooves 141 and 142 formed in the flange part 14*b* are arranged respectively point-symmetrically.

In the illustrated example, the first groove 141 is formed between the step surface 143 and the top surface 14A of the flange part 14. The first groove 141 and the second groove 142 are divided by a wall part 140 formed in the flange part 14.

Figure 2B:
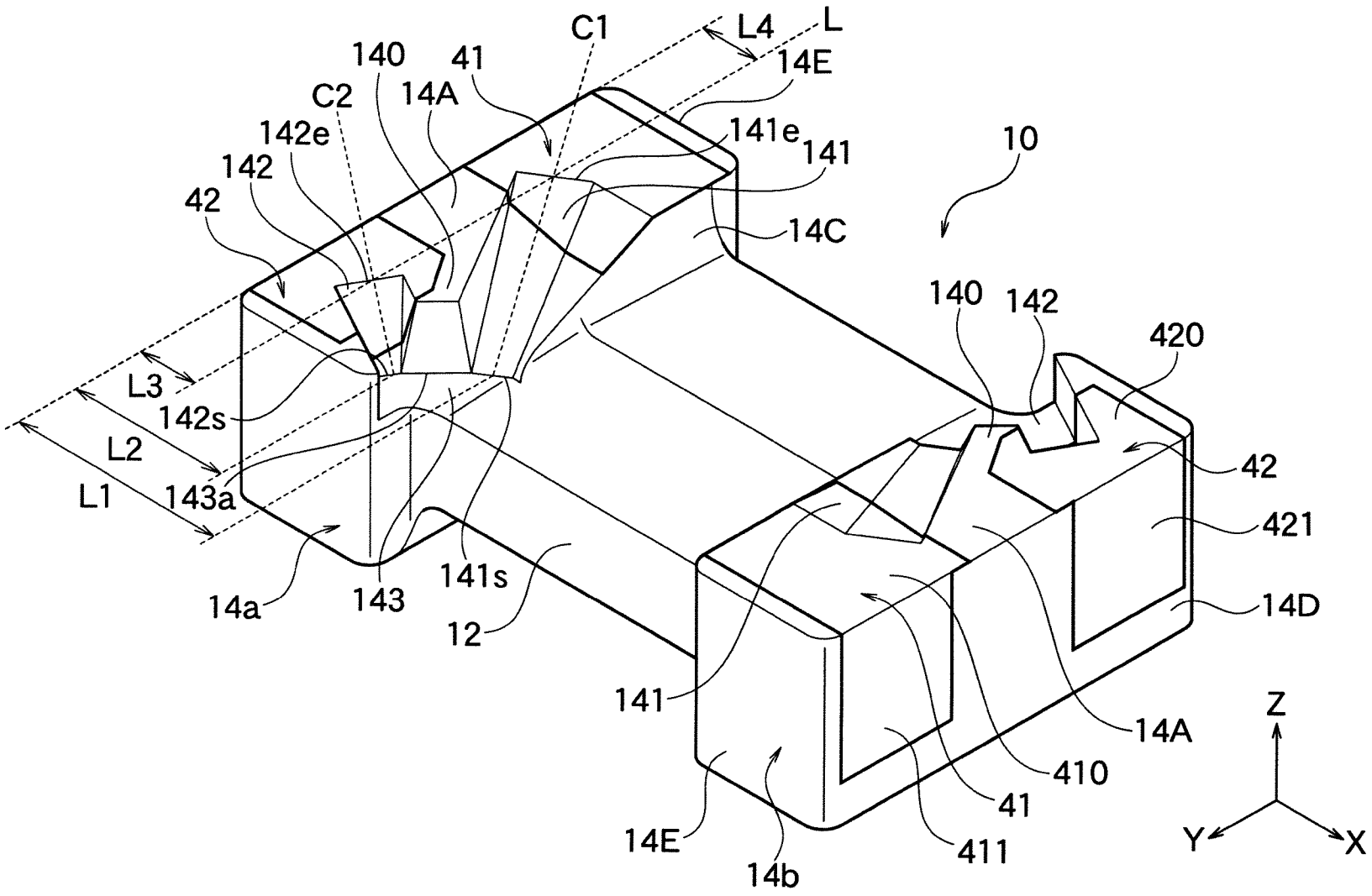
FIG. 2B is a perspective view illustrating a next step of FIG. 2A.

As shown in FIG. 2A, the first groove 141 extends diagonally toward the outside of the flange part 14 and tilts gradually downward, and the second groove 142 extends diagonally toward the outside of the flange part 14 at an angle differing from that of the first groove 141 and tilts gradually downward. As shown in FIG. 2B, an extended line C1 of a center axis of the first groove 141 crosses the end surface 14D of the flange part 14, and an extended line C2 of a center axis of the second groove 142 similarly crosses the end surface 14D of the flange part 14.

In the present embodiment, as shown in FIG. 2B, a first start tip 141*s* of the first groove 141 and a second start tip 142*s* of the second groove 142 are arranged at different positions along a periphery 143*a* of the step surface 143.

Incidentally, the first start tip 141*s* of the first groove 141 corresponds to a crossing part between the step surface 143 and the first groove 141 (first inclined surface 141*a* mentioned below), the second start tip 142*s* of the second groove 142 corresponds to a crossing part between the step surface 143 and the second groove 142 (second inclined surface 142*a* mentioned below), a first end tip 141*e* of the first groove 141 corresponds to a crossing part between the top surface 14A of the flange part 14 and the first groove 141 (first inclined surface 141*a* mentioned below), and a second end tip 142*e* of the second groove 142 corresponds to a crossing part between the top surface 14A of the flange part 14 and the second groove 142 (second inclined surface 142*a* mentioned below).

A distance L1 between the first start tip 141*s* of the first groove 141 and the outer end surface 14D of the flange part 14 and a distance L2 between the second start tip 142*s* of the second groove 142 and the outer end surface 14D of the flange part 14 are different from each other. In the present embodiment, L1>L2 is satisfied.

On the other hand, a distance L3 between the first end tip 141*e* of the first groove 141 and the outer end surface 14D of the flange part 14 and a distance L4 between the second end tip 142*e* of the second groove 142 and the outer end surface 14D of the flange part 14 are substantially equal to each other. That is, the first end tip 141*e* of the first groove 141 and the second end tip 142*e* of the second groove 142 are positioned on a straight line L passing the top surface 14A of the flange part 14 and being parallel to the outer end surface 14D of the flange part 14.

In the present embodiment, as shown in FIG. 1A, the leading part 310 of the first wire 31 passes the first groove 141 of the flange part 14*a*, and the leading part 320 of the second wire 32 passes the second groove 142 of the flange part 14*a*. The leading part 320 of the second wire 32 passes the first groove 141 of the flange part 14*b*, and the leading part 310 of the first wire 31 passes the second groove 142 of the flange part 14*b*.

For more detail, the leading part 310 of the first wire 31 is drawn from the coil portion 30, passes the step surface 143 without any contact, and extends diagonally toward the first terminal electrode 41 in the first groove 141. The first wire 31 is wired in the air from the step surface 143 to the front of the first end tip 141*e* of the first groove 141 and is in contact with the bottom of the first groove 141 (first inclined surface 141*a* mentioned below) in front of the first end tip 141*e* of the first groove 141.

The leading part 320 of the second wire 32 is drawn from the coil portion 30 and engaged with the curved part 144 shown in FIG. 2A, passes the step surface 143 without any contact, and extends diagonally toward the second terminal electrode 42 in the second groove 142. The second wire 32 is wired in the air from the step surface 143 to the front of the second end tip 142*e* of the second groove 142 and is in contact with the bottom of the second groove 142 (second inclined surface 142*a* mentioned below) in front of the second end tip 142*e* of the second groove 142.

Incidentally, the leading part 320 of the second wire 32 is temporarily disposed from the second layer to the first layer of the coil portion 30 and is thereafter drawn toward the second terminal electrode 42.

As shown in FIG. 2A, the first groove 141 includes a first inclined surface 141*a*, a first wall-side surface 141*b*, and a first inclined side surface 141*c*. The first inclined surface 141*a* is disposed between the first wall-side surface 141*b* and the first inclined side surface 141*c* and is inclined from one end of the flange part 14 in the Y-axis direction (or the outer end surface 14D) to the other end of the flange part 14 in the Y-axis direction (or the inner end surface 14C).

The first wall-side surface 141*b* forms a part of the wall part 140 and is formed closer to the outer end surface 14D than the first inclined surface 141*a*. The first inclined side surface 141*c* is formed closer to the inner end surface 14C than the first inclined surface 141*a*. The first inclined side surface 141*c* is an inclined surface gradually descending from one end of the flange part 14 in the Y-axis direction to the other end of the flange part 14 in the Y-axis direction on the inner end surface 14C of the flange part 14.

The second groove 142 includes a second inclined surface 142*a*, a second wall-side surface 142*b*, and a second outer-side surface 142*c*. The second inclined surface 142*a* is disposed between the second wall-side surface 142*b* and the second outer-side surface 142*c* and is inclined from one end of the flange part 14 in the Y-axis direction (or the outer end surface 14D) to the other end of the flange part 14 in the Y-axis direction (or the inner end surface 14C).

The second wall-side surface 142*b* forms a part of the wall part 140 and is formed closer to the first side surface 14E than the second inclined surface 142*a*. The second outer side-surface 142*c* is formed closer to the second side surface 14F than the second inclined surface 142*a*.

The first groove 141 and the second groove 142 become wider toward the outside of the flange part 14. Preferably, a width of the first inclined surface 141*a* of the first groove 141 is about twice to five times larger than a diameter of the first wire 31 or the second wire 32. This is also the case with a width of the second inclined surface 142*a* of the second groove 142.

Figure 5:
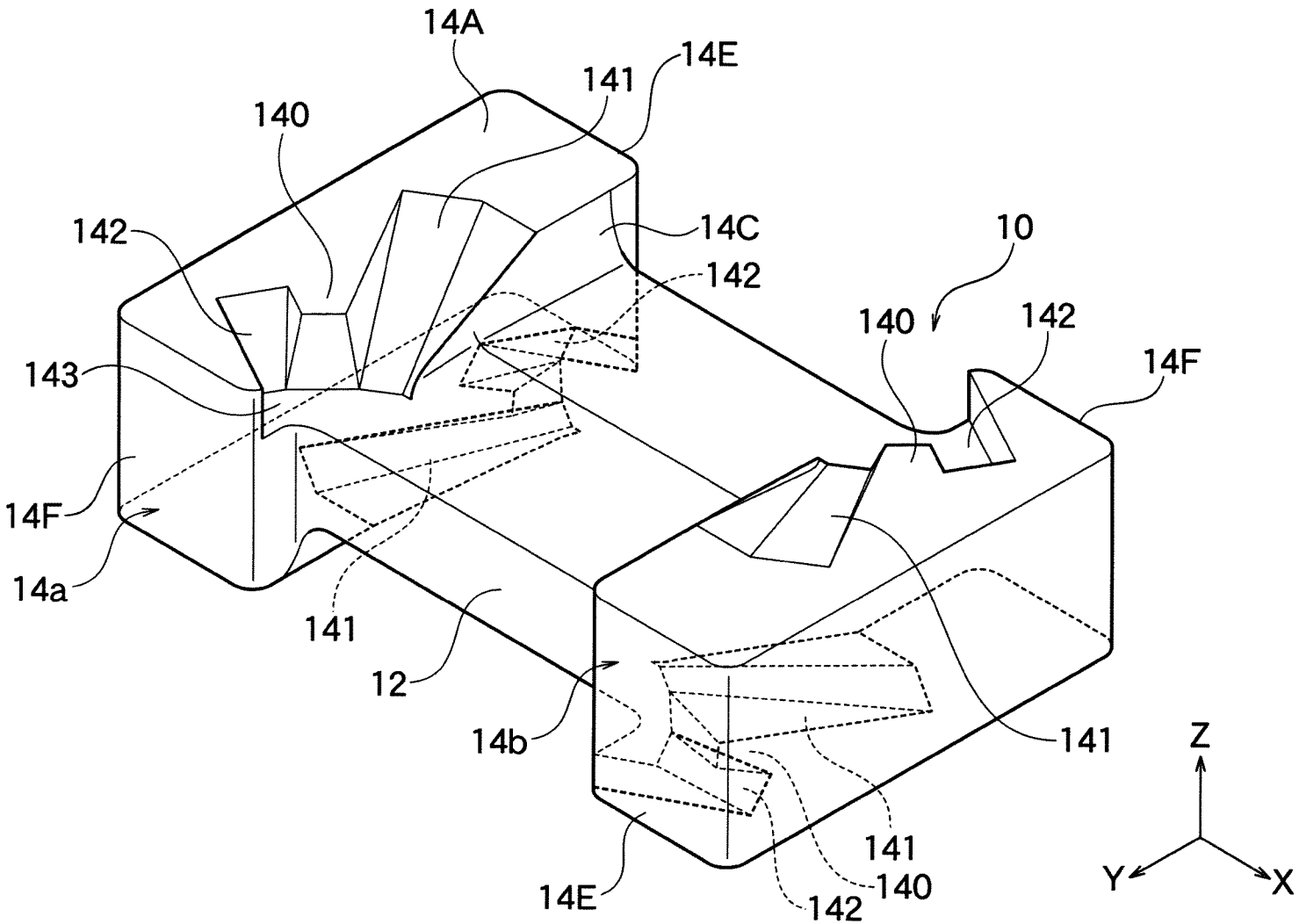
FIG. 5 is a whole perspective view of a variation of a core owned by the coil device shown in FIG. 1A.

In the example of FIG. 2A, the first groove 141 and the second groove 142 are formed only on the top surface 14A of the flange part 14, but may also be formed on the bottom surface 14B of the flange part 14 as shown in FIG. 5. In this case, each of the first groove 141 and the second groove 142 preferably extends in the corresponding direction between the top surface (front surface) 14A and the bottom surface (back surface) 14B of the flange part 14 so that an outer shape of the flange part 14 seen from the top surface 14A and an outer shape of the flange part 14 seen from the bottom surface 14B correspond to each other in reversing the core 10.

In manufacturing the coil device 1, the drum-type core 10 and the wires 31 and 32 are initially prepared. Incidentally, the wires 31 and 32 may be obtained by, for example, covering a core material of good conductor of copper (Cu) or so with an insulation material of imide-modified polyurethane or so and further covering the outermost surface with a thin resin film of polyester or so.

Examples of magnetic materials constituting the drum core 10 include a magnetic material having a comparatively high permeability, such as Ni—Zn based ferrite and Mn—Zn based ferrite, and a metal magnetic material. The drum core 10 is manufactured by molding and sintering the powder of these magnetic materials. At this time, as shown in FIG. 2A, the first groove 141, the second groove 142, and the step surface 143 are formed integrally at each part of the flange part 14 in the drum core 10. In the drum core 10, the winding core part 12 and a pair of flange parts 14 are formed integrally.

Next, a metal paste is applied to the top surface 14A and the outer end surface 14D of the flange part 14 of the drum core 10, baked at a predetermined temperature, and electroplated or non-electroplated. Then, the first terminal electrode 41 and the second terminal electrode 42 as shown in FIG. 2B are formed.

Incidentally, the metal paste is made of any material, such as Cu paste and Ag paste. The plating film may be single layer or plural layers, such as Cu plating, Ni plating, Sn plating, Ni—Sn plating, Cu—Ni—Sn plating, Ni—Au plating, and Au plating. Each of the terminal electrodes 41 and 42 has any thickness, but preferably has a thickness of 0.1 to 15 μm.

Figure 2C:
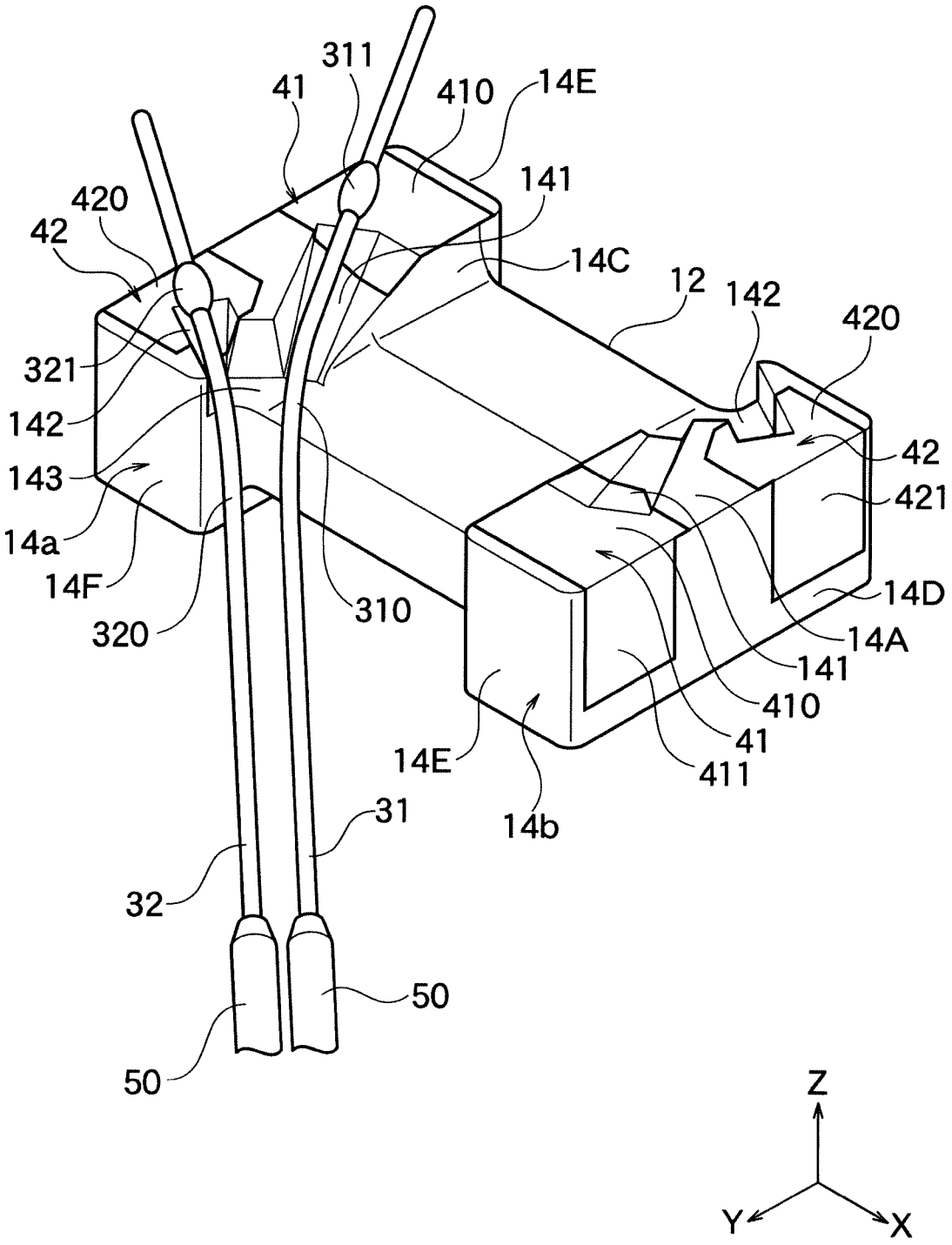
FIG. 2C is a perspective view illustrating a next step of FIG. 2B.

Next, the drum core 10 with the terminal electrodes 41 and 42 and the wires 31 and 32 are set to a winding machine (not shown), and as shown in FIG. 2C, the first wire 31 (leading part 310) is drawn from a tip of a nozzle 50 and connected to the first top-surface electrode part 410 of the first terminal electrode 41. The first wire-connection part 311 is thereby formed at a connection part between the first top-surface electrode part 410 and the first wire 31.

Likewise, the second wire 32 (leading part 320) is drawn from a tip of a nozzle 50 and connected to the second top-surface electrode part 420 of the second terminal electrode 42. The second wire-connection part 321 is thereby formed at a connection part between the second top-surface electrode part 420 and the second wire 32.

Incidentally, the wires 31 and 32 are connected by any method. For example, the wire 31 (32) is thermocompressed to the terminal electrode 41 (42) by pushing a heater chip against the wire 31 (32) while being sandwiched by the heater chip and the terminal electrode 41 (42). Incidentally, the insulation material covering the wire core of the wire 31 (32) is molten by heat of thermocompression, and there is thereby no need to remove the cover film of the wire 31 (32).

Figure 2D:
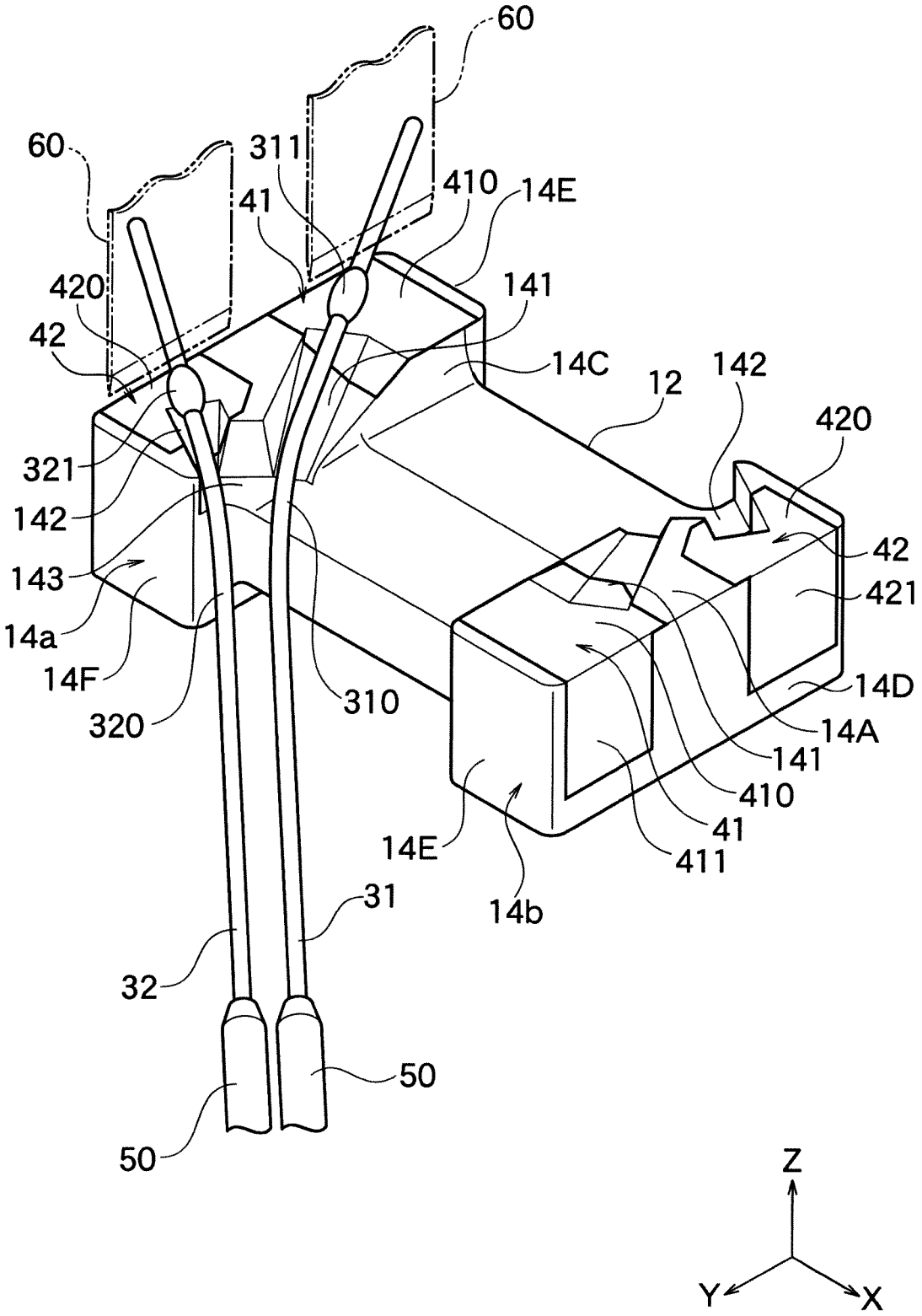
FIG. 2D is a perspective view illustrating a next step of FIG. 2C.

As shown in FIG. 2D, an unnecessary part of the first wire 31 (leading part 310) protruding from the first top-surface electrode part 410 (first terminal electrode 41) toward the outside of the outer end surface 14D of the flange part 14*a* is cut by a cutting device 60. When the unnecessary part of the leading part 310 is cut, a cut-scheduled part of the leading part 310 is disposed near the outer end surface 14D of the flange part 14, and the cutting device 60 is disposed (positioned) so that the side surface of the cutting device 60 is approximately flush with the outer end surface 14D.

At the position, the cutting device 60 is lowered along the first end surface 14D in the Z-axis direction. This makes it possible to cut the cut-scheduled part of the leading part 310 without the contact of the cutting device 60 with the top surface 14A of the flange part 14 and to prevent breakage of the flange part 14.

Likewise, an unnecessary part of the second wire 32 (leading part 320) protruding from the second top-surface electrode part 420 (second terminal electrode 42) toward the outside of the outer end surface 14D of the flange part 14*a* is cut by a cutting device 60. When the unnecessary part of the leading part 320 is cut, a cut-scheduled part of the leading part 320 is disposed near the outer end surface 14D of the flange part 14*a*, and the cutting device 60 is disposed (positioned) so that the side surface of the cutting device 60 is approximately flush with the outer end surface 14D.

At the position, the cutting device 60 is lowered along the first end surface 14D in the Z-axis direction. This makes it possible to cut the cut-scheduled part of the leading part 320 without the contact of the cutting device 60 with the top surface 14A of the flange part 14 and to prevent breakage of the flange part 14.

Figure 2E:
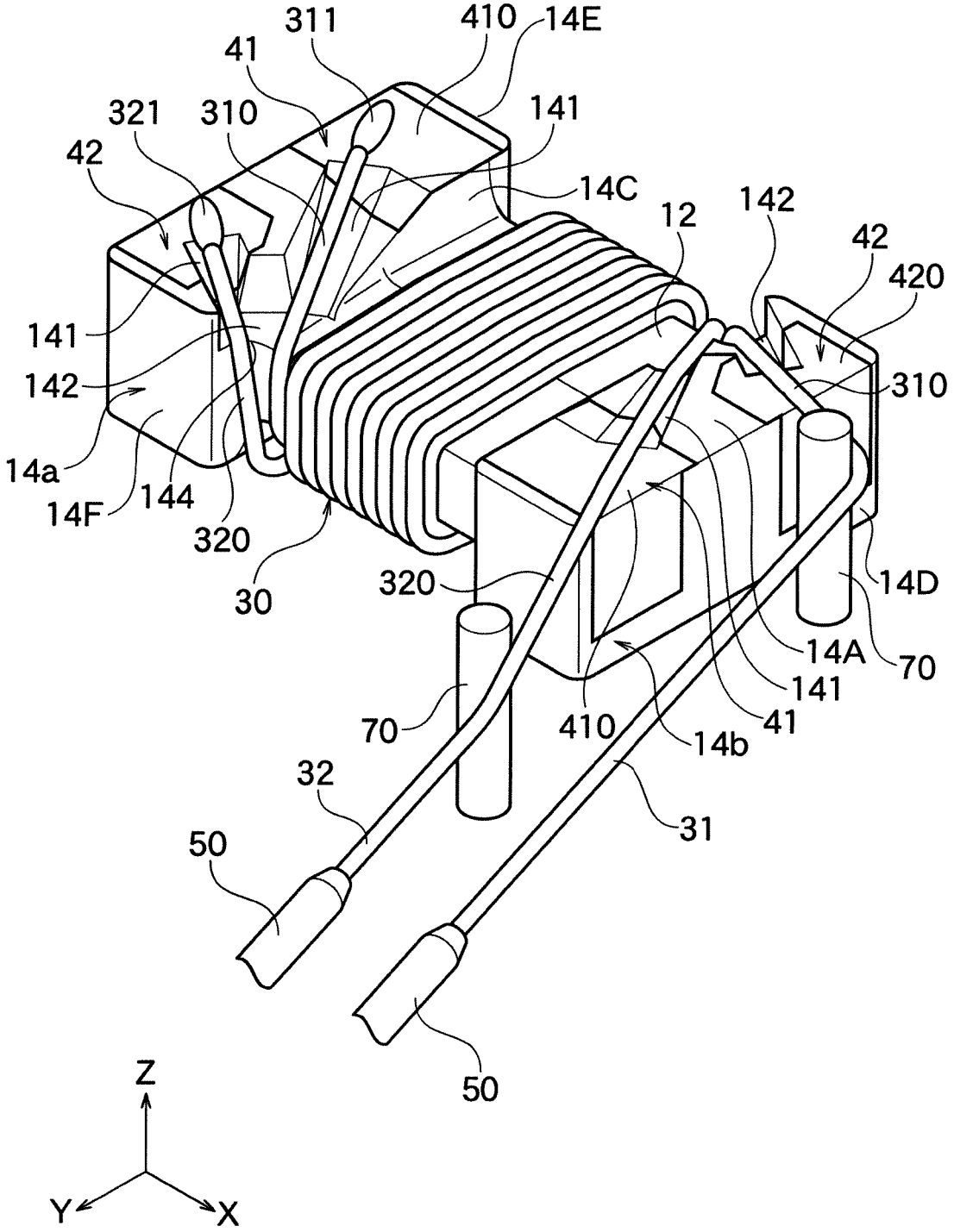
FIG. 2E is a perspective view illustrating a next step of FIG. 2D.

Next, as shown in FIG. 2E, the first wire 31 (leading part 310) is drawn diagonally to the outer circumference of the winding core part 12 along the inclined surface of the first groove 141 via the step surface 143 of the flange part 14*a* and is wound around the winding core part 12. Likewise, the second wire 32 (leading part 320) is drawn diagonally to the outer circumference of the winding core part 12 along the inclined surface of the second groove 142 while being engaged with the curved part 144 and is wound around the winding core part 12. Then, the coil portion 30 is formed. Incidentally, the present step may be carried out before the cutting of the above-mentioned unnecessary parts of the first and second wires 31 and 32. The first and second wires 31 and 32 may be wound around the winding core part 12 in pairs or independently.

The wire 31 (leading part 310) is drawn diagonally from the outer circumference of the winding core part 12 so as to pass the top-surface electrode part 420 of the second terminal electrode 42 via the second groove 142 while being engaged with the curved part 144 and is hooked and fixed to a column 70 without looseness.

Likewise, the wire 32 (leading part 320) is drawn diagonally from the outer circumference of the winding core part 12 so as to pass the top-surface electrode part 410 of the first terminal electrode 41 via the first groove 141 from above the step surface 143 and is hooked and fixed to a column 70 without looseness.

Figure 2F:
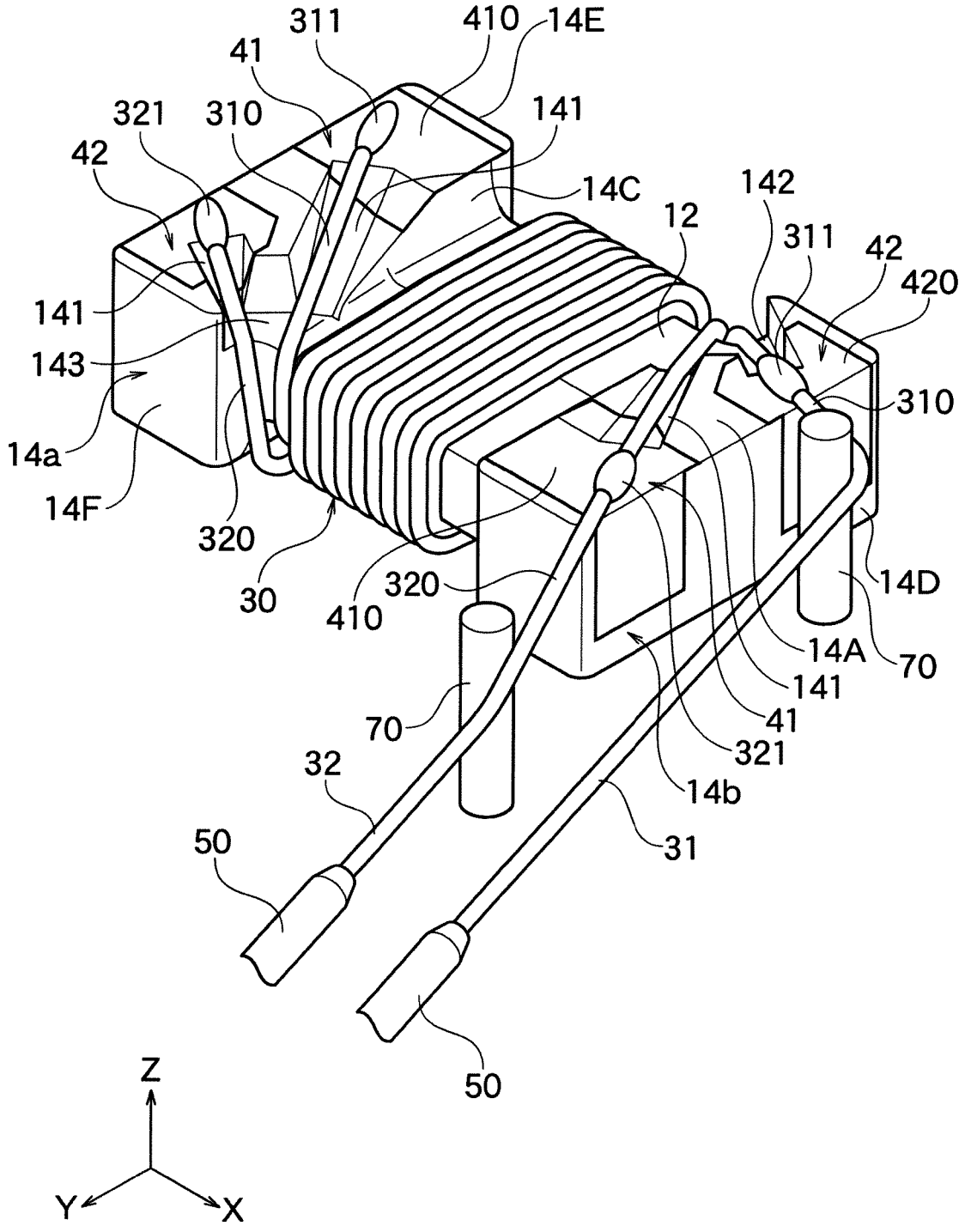
FIG. 2F is a perspective view illustrating a next step of FIG. 2E.

Next, as shown in FIG. 2F, the first wire 31 is connected to the second top-surface electrode part 420 of the second terminal electrode 42, and the first wire-connection part 311 is thereby formed at a connection part between the second top-surface electrode part 420 and the first wire 31.

Likewise, the second wire 32 is connected to the first top-surface electrode part 410 of the first terminal electrode 41, and the second wire-connection part 321 is thereby formed at a connection part between the first top-surface electrode part 410 and the second wire 32.

Figure 2G:
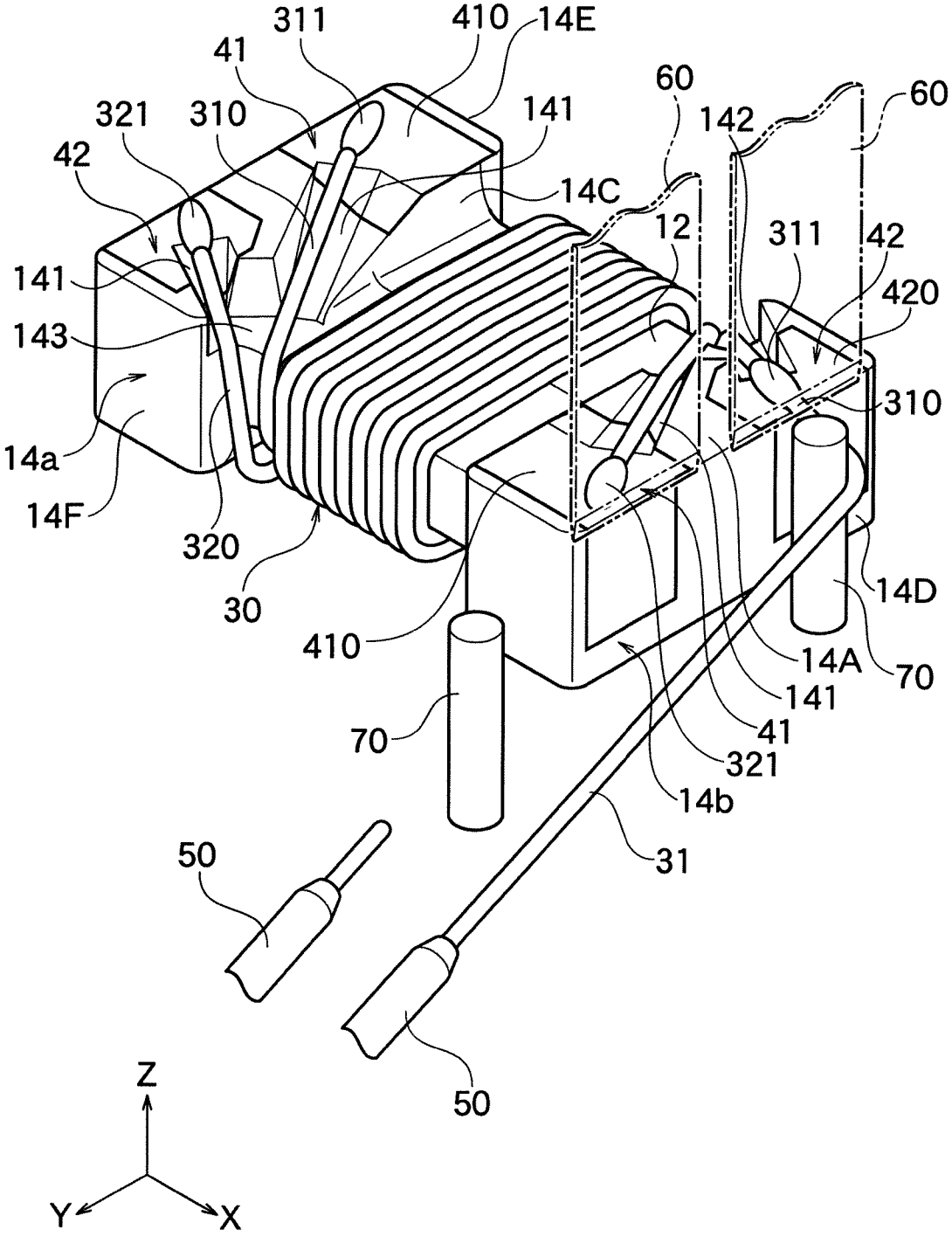
FIG. 2G is a perspective view illustrating a next step of FIG. 2F.

Next, as shown in FIG. 2G an unnecessary part of the first wire 31 (leading part 310) protruding from the second top-surface electrode part 420 (second terminal electrode 42) toward the outside of the outer end surface 14D of the flange part 14*b* is cut by a cutting device 60 in a similar manner to the explanation using FIG. 2D. Likewise, an unnecessary part of the second wire 32 (leading part 320) protruding from the first top-surface electrode part 410 (first terminal electrode 41) toward the outside of the outer end surface 14D of the flange part 14*b* is cut by a cutting device 60.

Figure 4:
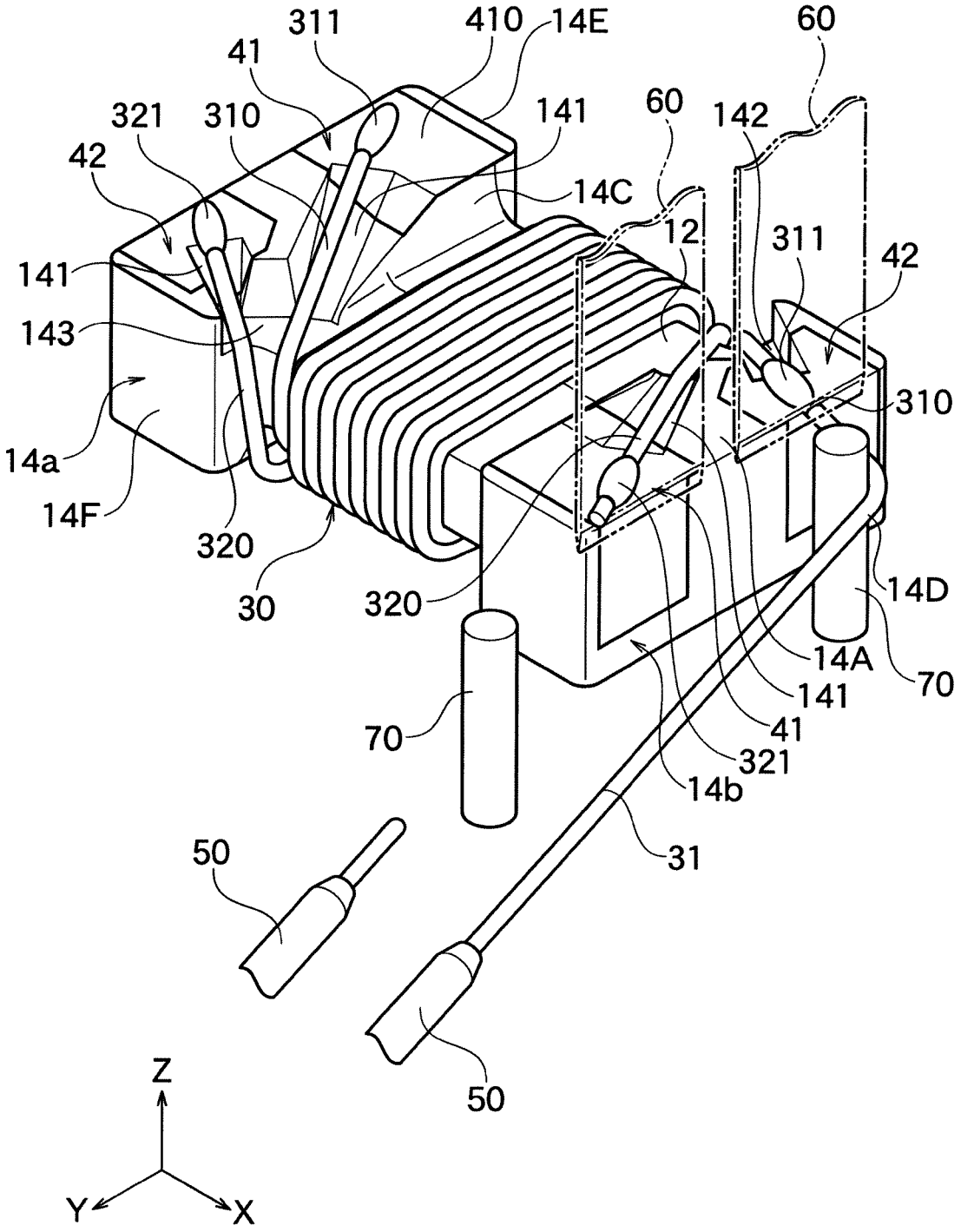
FIG. 4 is another perspective view illustrating the step of FIG. 3C.

As shown in FIG. 4, when the unnecessary part of the second wire 32 (leading part 320) is cut, the unnecessary part of the second wire 32 may remain at the tip of the second wire-connection part 321. Although not illustrated in detail, this is also the case with the first wire 31 (leading part 310).

Figure 2H:
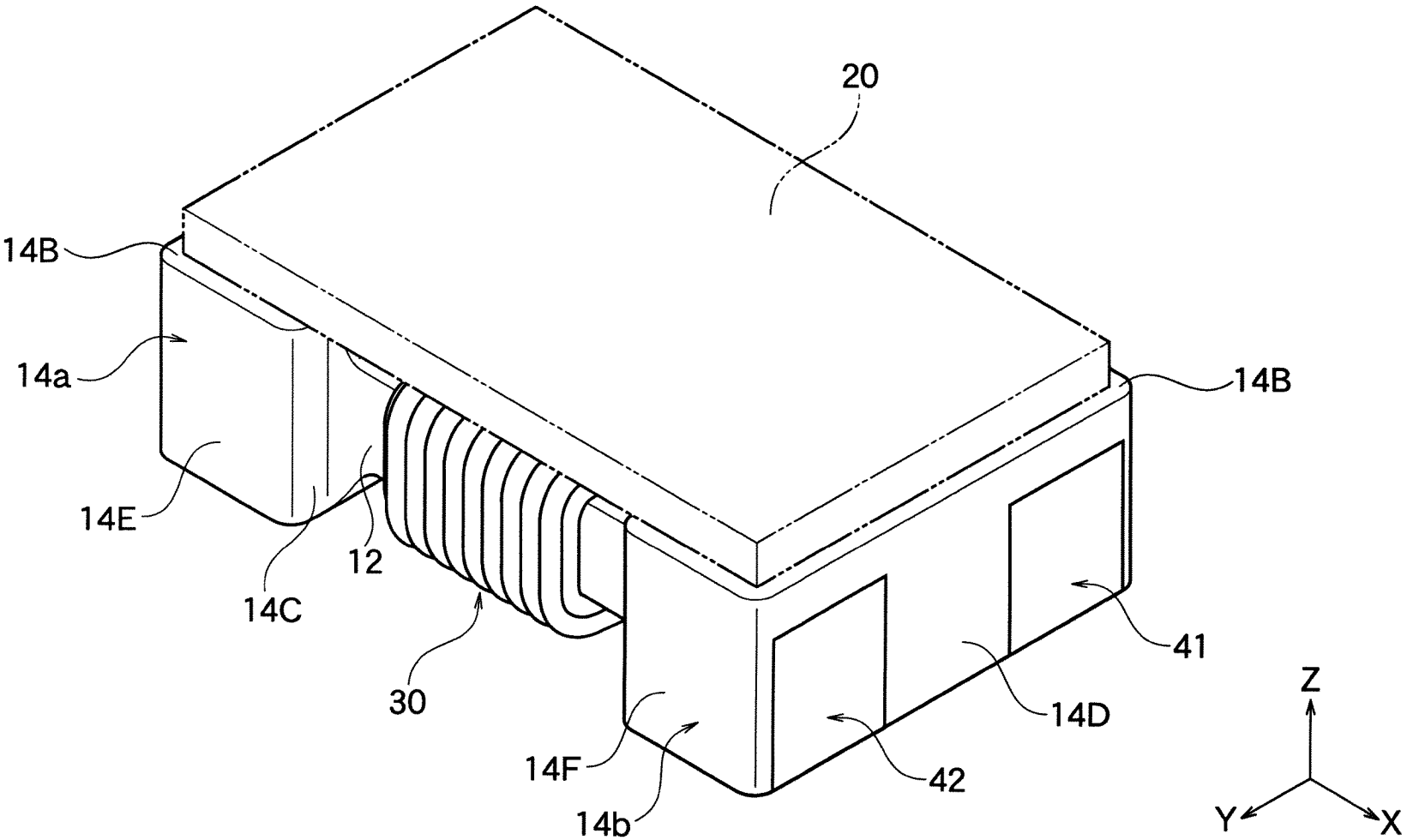
FIG. 2H is a perspective view illustrating a next step of FIG. 2G

Next, as shown in FIG. 2H, a plate core 20 is installed on the bottom surfaces 14B of the flange parts 14. The bottom surfaces 14B are a flat surface and easily install the plate core 20. The plate core 20 is a flat parallelepiped with flat surfaces and has an effect of increase in inductance of the coil device 1. The plate core 20 is preferably formed by the same magnetic member as the drum core 10, but the plate core 20 and the drum core 10 may be formed by different members. Incidentally, the plate core 20 is not necessarily formed by a magnetic material, and may be formed by a non-magnetic material, such as synthetic resin.

In the coil device 1 according to the present embodiment, the flange part 14 includes the first and second grooves 141 and 142 passed by either of the leading parts 310 and 320 of the first and second wires 31 and 32. Unlike the prior arts, the leading parts 310 and 320 of the first and second wires 31 and 32 are thereby drawn to the terminal electrodes 41 and 42 via the first groove 141 or the second groove 142. Thus, the insulation covers of the first and second wires 31 and 32 are less likely to be broken, and a short circuit failure between the first and second wires 31 and 32 and the core 10 can be prevented from occurring.

In the coil device 1 according to the present embodiment, the first groove 141 extends toward the outside of the flange part 14, and the second groove 142 extends toward the outside of the flange part 14 at an angle differing from that of the first flange part 141. Thus, a leading part of a wire passing through the first groove 141 and a leading part of a wire passing through the second groove 142 are drawn in different directions, and the leading part 310 of the first wire 31 and the leading part 320 of the second wire 32 can sufficiently be separated from each other. It is thereby possible to prevent the leading parts 310 and 320 of the wires 31 and 32 from crossing each other in the boundary between the flange part 14 and the winding core part 12 and to prevent generation of short circuit failure between the wires.

In the coil device 1 according to the present embodiment, the wire 31 (32) is drawn along the groove 141 (142) in drawing each of the leading parts 310 and 320 of the first and second wires 31 and 32 to the terminal electrode 41 (42), and a sliding movement of the wires 31 and 32 is limited by the grooves 141 and 142. Thus, the insulation covers of the wires 31 and 32 are less likely to be broken, and a short circuit failure between the wires 31 and 32 and the core 10 can be prevented from occurring.

In the present embodiment, each of extended lines C1 and C2 of center axes of the first and second grooves 141 and 142 crosses the outer end surface 14D of the flange part 14. In this structure, the second groove 142 extends toward the outer end surface 14D of the flange part 14, and the leading parts 310 and 320 of the wires 31 and 32 can be drawn toward the outer end surface 14D of the flange part 14. Thus, after the wires 31 and 32 are connected to the terminal electrodes 41 and 42, the wires 31 and 32 are drawn to the outside of the outer end surface 14D of the flange part 14 and can be cut at the outside of the flange part 14 by, for example, moving a cutting device along the outer end surface 14D of the flange part 14. It is thereby possible to prevent the cutting device from breaking the flange part 14 at the time of cutting the wires 31 and 32.

In the present embodiment, the first and second grooves 141 and 142 become wider toward the outside of the flange part 14. In this structure, the first and second grooves 141 and 142 become wider as they approach the terminal electrodes 41 and 42, and the first and second wires 31 and 32 can easily be inserted into the grooves 141 and 142 at the time of drawing the leading parts 310 and 320 of the wires 31 and 32 to the terminal electrodes 41 and 42 or at the beginning of winding the wires 31 and 32.

In the present embodiment, the flange part 14 includes the wall part 140 dividing the first and second grooves 141 and 142. In this structure, the first wire 31 passing through the first groove 141 and the second wire 32 passing through the second groove 142 are less likely to contact with each other, and a short circuit failure between the wires can effectively be prevented from occurring.

In the present embodiment, the step surface 143 is formed around the boundary between the flange part 14 and the winding core part 12, and the first start tip 141*s* of the first groove 141 and the second start tip 142*s* of the second groove 142 are arranged at different positions along the periphery 143*a* of the step surface 143. When the step surface 143 as mentioned above is formed, the first and second wires 31 and 32 are led to the middle of each of the grooves 141 and 142 without contacting with the step surface 143 of the flange part 14 around the first and second start tips 141*s* and 142*s* and do not bend sharply, and the insulation covers of the first and second wires 31 and 32 can effectively be prevented from being broken.

A space between each of the wires 31 and 32 and the flange part 14 is formed around the boundary between the flange part 14 and the winding core part 12, and the leading part 310 of the first wire 31 can be wired in the air to the front of the first end tip 141*e* of the first groove 141 and is easily drawn to the terminal electrodes 41 and 42 via the first groove 141. Likewise, the leading part 320 of the second wire 32 can be wired in the air from above the step surface 143 to the front of the second end tip 142*e* of the second groove 142 and is easily drawn to the terminal electrodes 41 and 42 via the second groove 142.

In the present embodiment, a distance L1 between the first start tip 141*s* of the first groove 141 and the outer end surface 14D of the flange part 14 and a distance L2 between the second start tip 142*s* of the second groove 142 and the outer end surface 14D of the flange part 14 are different from each other. In this structure, the first start tip 141*s* of the first groove 141 and the second start tip 142*s* of the second groove 142 are arranged separately on the step surface 143. It is thereby possible to sufficiently separate a wire passing through the first start tip 141*s* and a wire passing through the second start tip 142*s*, to prevent the leading parts 310 and 320 of the wires 31 and 32 from crossing each other around the boundary between the flange part 14 and the winding core part 12 (i.e., step surface 143), and to effectively prevent generation of short circuit failure between the wires.

In the present embodiment, a distance L3 between the first end tip 141*e* of the first groove 141 and the outer end surface 14D of the flange part 14 and a distance L4 between the second end tip 142*e* of the second groove 142 and the outer end surface 14D of the flange part 14 are substantially equal to each other. In this structure, a wire passing through the first end tip 141*e* of the first groove 141 and a wire passing through the second end tip 142*e* of the second groove 142 are arranged at positions having approximately the same distance from the outer end surface 14D of the flange part 14. Thus, the leading parts 310 and 320 of the wires 31 and 32 can be connected to the terminal electrodes 41 and 42 by, for example, being pushed together by a heater for thermo-compression.

In the present embodiment, an outer shape of the flange part 14 seen from the top surface 14A and an outer shape of the flange part 14 seen from the bottom surface 14B correspond to each other in reversing the core 10. In this structure, the terminal electrodes 41 and 42 can be formed on both of the top surface 14A and the bottom surface 14B of the flange part 14.

In the present embodiment, one of the leading parts 310 of the first wire 31 passes through the first groove 141 formed in the flange part 14*a* disposed at one end of the winding core part 12 in the axis direction, the other leading part 310 of the first wire 31 passes through the second groove 142 formed in the flange part 14*b* disposed at the other end of the winding core part 12 in the axis direction, one of the leading parts 320 of the second wire 32 passes through the second groove 142 formed in the flange part 14*a* disposed at one end of the winding core part 12 in the axis direction, and the other leading part 320 of the second wire 32 passes through the first groove 141 formed in the flange part 14*b* disposed at the other end of the winding core part 12 in the axis direction.

In this structure, both of the first wire 31 and the second wire 32 are wound around the winding core part 12, and coils of the first wire 31 and the second wire 32 having the same wire length can be formed.

In the present embodiment, the first terminal electrode 41 and the second terminal electrode 42 are formed on the top surface 14A of the flange part 14, the first terminal electrode 41 partially enters the first groove 141, and the second terminal electrode 42 partially enters the second groove 142. In this structure, the first terminal electrode 41 and the second terminal electrode 42 can also be formed on a part other than the outermost surface of the flange part 14 and can have a sufficient connection area with the first wire 31 and the second wire 32.

In the present embodiment, each of the leading parts 310 and 320 of the first and second wires 31 and 32 is connected to the first terminal electrode 41 or the second terminal electrode 42 so as to be close to the outer end surface 14D of the flange part 14. In this structure, the wires 31 and 32 are easily connected to the terminal electrodes 41 and 42, easily drawn to the outside of the outer end surface 14D of the flange part 14, and easily cut at the outside of the flange part 14.

Second Embodiment

Figure 3A:
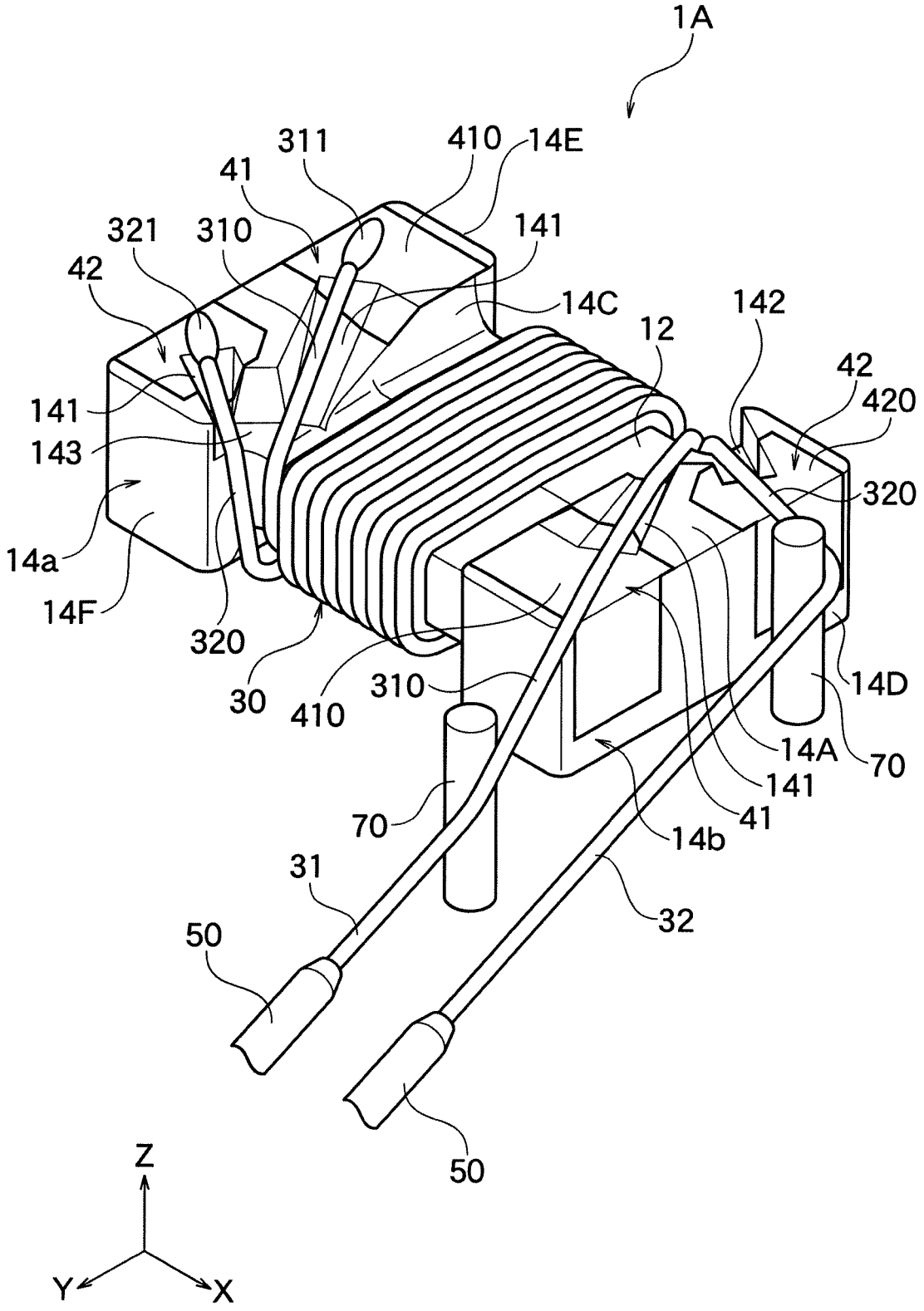
FIG. 3A is another perspective view illustrating a step of manufacturing the coil device shown in FIG. 1A.
Figure 3B:
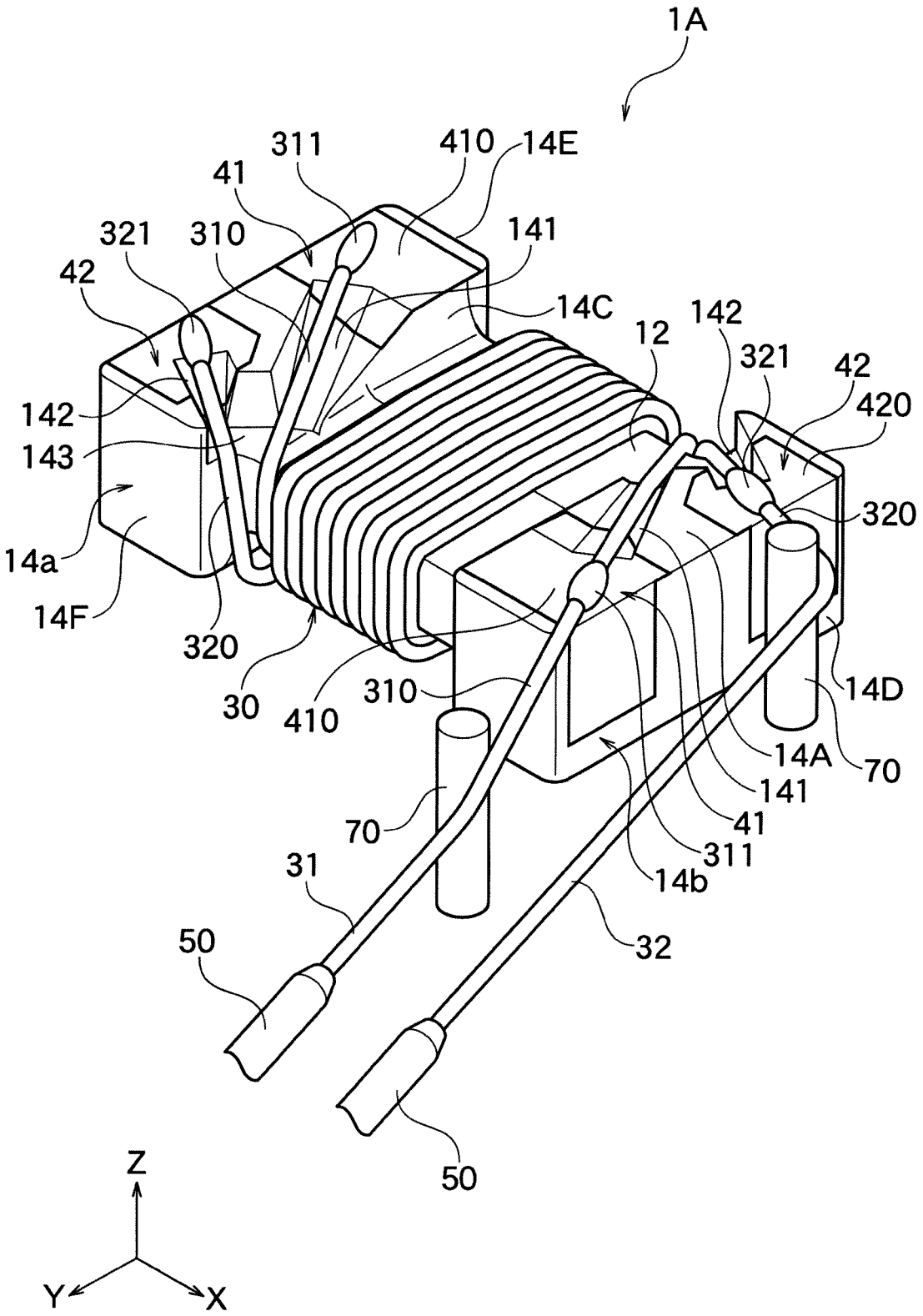
FIG. 3B is a perspective view illustrating a next step of FIG. 3A.
Figure 3C:
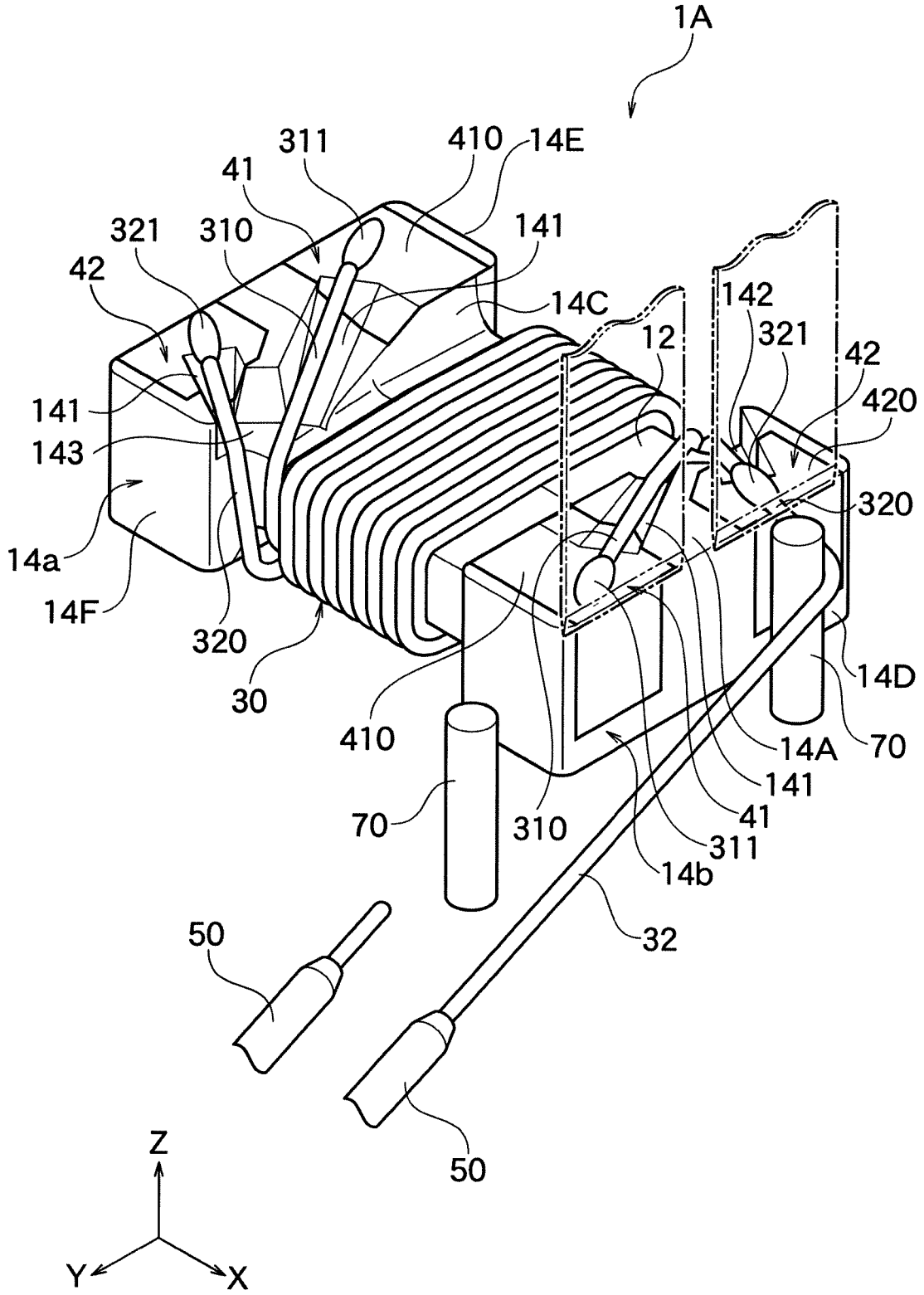
FIG. 3C is a perspective view illustrating a next step of FIG. 3B.

Except for the following matters, a coil device 1A according to Second Embodiment shown in FIG. 3A to FIG. 3C has the structure similar to that of the coil device 1 according to First Embodiment and demonstrates effects similar to those of the coil device 1 according to First Embodiment. Each member of the coil device 1A shown in FIG. 3A to FIG. 3C corresponds to each member of the coil device 1 according to First Embodiment shown in FIG. 2E to FIG. 2G etc. The corresponding members are provided with the same reference and are not partially explained.

As clearly shown from the comparison between FIG. 3B and FIG. 2F, the coil device 1A is different from the coil device 1 according to First Embodiment in that each of the leading parts 310 of the first wire 31 is connected to the first top-surface electrode part 410 of the first terminal electrode 41 of each of the flange parts 14*a* and 14*b*. Moreover, the coil device 1A is different from the coil device 1 according to First Embodiment in that each of the leading parts 320 of the second wire 32 is connected to the second top-surface electrode part 420 of the second terminal electrode 42 of each of the flange parts 14*a* and 14*b*.

In manufacturing the coil device 1A, each step shown in FIG. 2A to FIG. 2D is initially carried out in the manner shown in First Embodiment. Next, the positional relation between the first wire 31 and the second wire 32 is reversed from one shown in FIG. 2E, for example, before or after the coil portion 30 is formed.

Then, the leading part 310 of the first wire 31 is drawn to the first top-surface electrode part 410 of the first terminal electrode 41 of the flange part 14*b* as shown in FIG. 3A and is connected thereto as shown in FIG. 3B, and the first wire-connection part 311 is formed. Likewise, the leading part 320 of the second wire 32 is drawn to the second top-surface electrode part 420 of the second terminal electrode 42 of the flange part 14*b* as shown in FIG. 3A and is connected thereto as shown in FIG. 3B, and the second wire-connection part 321 is formed.

As shown in FIG. 3C, an unnecessary part of the first wire 31 (leading part 310) protruding from the first top-surface electrode part 410 toward the outside of the outer end surface 14D of the flange part 14*b* is cut by a cutting device 60, and an unnecessary part of the second wire 32 (leading part 320) protruding from the second top-surface electrode part 420 toward the outside of the outer end surface 14D of the flange part 14*b* is cut by a cutting device 60.

Effects similar to those of First Embodiment can be obtained in the present embodiment. In addition, the present embodiment can obtain the coil device 1A having different wire lengths of the first wire 31 and the second wire 32 and having electronic characteristics that are different from those of the coil device 1 according to First Embodiment.

Incidentally, the present invention is not limited to the above-mentioned embodiments and may variously be changed within the scope of the present invention.

In the above-mentioned embodiments, the top surfaces 14A of the flange parts 14 are a mount surface, but the bottom surfaces 14B may be a mount surface, and the plate core 20 may be installed on the top surfaces 14A.

In the above-mentioned embodiments, the step surfaces 143 are a step surface having an approximately plane shape, but may be a step surface having a curved surface.

In the above-mentioned embodiments, the extended line C1 of the center axis of the first groove 141 crosses the end surface 14D of the flange part 14, but may cross the first side surface 14E of the flange part 14.

In the above-mentioned embodiments, as shown in FIG. 2B, the extended lines C1 and C2 of the center axes of the first and second grooves 141 and 142 cross the outer end surface 14D of the flange part 14, but the extended line C1 of the center axis of the first groove 141 may cross the first side surface 14E of the flange part 14. In this case, after the wires 31 and 32 are connected to the terminal electrodes 41, the wires 31 and 32 are drawn to the outside of the first side surfaces 14E of the flange parts 14 and can be cut at the outside of the flange parts 14 by, for example, moving a cutting device along the first side surfaces 14E of the flange parts 14.

NUMERICAL REFERENCES

1, 1A . . . coil device
10 . . . drum core
12 . . . winding core part
14*a*, 14*b* . . . flange
14A . . . top surface
14B . . . bottom surface
14C . . . inner end surface
14D . . . outer end surface
14E . . . first side surface
14F . . . second side surface
140 . . . wall part
141 . . . first groove
141*a* . . . first inclined surface
141*b* . . . first wall-side surface
141*c* . . . first inclined side surface
141*s* . . . first start tip
141*e* . . . first end tip
142 . . . second groove
142*a* . . . second inclined surface
142*b* . . . second wall-side surface
142*c* . . . second outer side surface
142*s* . . . second start tip
142*e* . . . second end tip
143 . . . step surface
143*a* . . . periphery
144 . . . curved part
20 . . . plate core
30 . . . coil portion
31 . . . first wire
310 . . . leading part
311 . . . first wire-connection part
32 . . . second wire
320 . . . leading part
321 . . . second wire-connection part
41 . . . first terminal electrode
410 . . . first top-surface electrode part
411 . . . first side-surface electrode part
42 . . . second terminal
420 . . . second top-surface electrode part
421 . . . second side-surface electrode part
50 . . . nozzle
60 . . . cutting device
70 . . . column

What is claimed is:

1. A coil device comprising:

a core including a winding core part and a flange part at one end of the winding core part in an axial direction of a longitudinal axis of the winding core part;

a coil portion having windings of a first wire and a second wire around the winding core part;

a first terminal electrode; and a second terminal electrode, wherein the flange part has a longitudinal dimension that is orthogonal to the longitudinal axis and is bisected by the longitudinal axis such that first and second portions of the flange part are on opposite sides of the longitudinal axis, the first terminal electrode is at the first portion and the second terminal electrode is at the second portion, the flange part includes a first groove that receives a leading part of the first wire and a second groove that receives a leading part of the second wire, the first groove extends (1) from a surface of the flange portion that is co-planar with a boundary between the winding core part and the flange part to the first terminal electrode and (2) obliquely to the longitudinal axis at a first angle relative to the longitudinal axis, the second groove extends (1) from the surface of the flange portion that is co-planar with the boundary between the winding core part and the flange part to the second terminal electrode and (2) obliquely to the longitudinal axis at a second angle relative to the longitudinal axis, and the first and second angles are different.

2. The coil device according to claim 1, wherein center axes of the first and second grooves cross an end surface of the flange part.

3. The coil device according to claim 1, wherein the first and second grooves become wider toward the first and second terminal electrode.

4. The coil device according to claim 1, wherein the flange part comprises a wall part dividing the first and second grooves.

5. The coil device according to claim 1, wherein the flange part includes a step surface with an edge at the boundary between the winding core part and the flange part, the step surface is the surface of the flange portion that is co-planar with the boundary between the winding core part and the flange part, and a first start tip of the first groove and a second start tip of the second groove are at different positions along a periphery of the step surface.

6. The coil device according to claim 1, wherein a distance between a first start tip of the first groove and an end surface of the flange part and a distance between a second start tip of the second groove and the end surface of the flange part are different from each other.

7. The coil device according to claim 1, wherein a distance between a first end tip of the first groove and an end surface of the flange part and a distance between a second end tip of the second groove and the end surface of the flange part are substantially equal to each other.

8. The coil device according to claim 1, wherein an outer shape of the flange part seen from a front surface of the core and an outer shape of the flange part seen from a back surface of the core correspond to each other in reversing the core.

9. The coil device according to claim 1, wherein the coil portion comprises:

a first layer of the first wire; and a second layer of the second wire on an outer circumference of the first layer.

10. The coil device according to claim 1, further comprising an opposite flange part at a second end of the winding core part in the axial direction and including a third groove corresponding to the first groove and a fourth groove corresponding to the second groove, wherein a second leading part of the first wire is received in the fourth groove, and a second leading part of the second wire is received in the third groove.

11. The coil device according to claim 1, wherein:

the first terminal electrode is on a surface of the flange part and partially in the first groove; and a second terminal electrode formed on the surface of the flange part and partially in the second groove.

12. The coil device according to claim 11, wherein the leading parts of each of the first and second wires are connected to the first and second terminal electrodes so as to be close to an end surface of the flange part.

13. A core comprising:

a winding core part; and a flange part at one end of the winding core part in an axial direction of a longitudinal axis of the winding core part, wherein the flange part includes first and second grooves, the first groove extends (1) from a first surface of the flange portion that is co-planar with a boundary between the winding core part and the flange part to a second surface of the flange portion that is configured to support a first terminal electrode and (2) obliquely to the longitudinal axis at a first angle relative to the longitudinal axis, the second groove extends (1) from the first surface of the flange portion that is co-planar with the boundary between the winding core part and the flange part to a third surface of the flange portion that is configured to support a second terminal electrode and (2) obliquely to the longitudinal axis at a second angle relative to the longitudinal axis, the first and second angles are different.

14. A coil device comprising:

a core including a winding core part and a flange part at one end of the winding core part in an axial direction of a longitudinal axis of the winding core part; and a coil portion having windings of a first wire and a second wire around the winding core part, wherein the flange part includes a first groove that receives a leading part of the first wire and a second groove that receives a leading part of the second wire, the first groove extends (1) from a surface of the flange portion that is co-planar with a boundary between the winding core part and the flange part to a first terminal electrode and (2) obliquely to the longitudinal axis at a first angle relative to the longitudinal axis, the second groove extends (1) from the surface of the flange portion that is co-planar with the boundary between the winding core part and the flange part to a second terminal electrode and (2) obliquely to the longitudinal axis at a second angle relative to the longitudinal axis, and the first and second angle are different, a step surface is around the boundary between the flange part and the winding core part, a first start tip of the first groove and a second start tip of the second groove are at different positions along a periphery of the step surface, at least a part of the step surface is inside an outermost surface of the flange part facing the winding core part, and the first start tip and the second start tip are inside the outermost surface of the flange part facing the winding core part.

15. A core comprising:

a winding core part; and a flange part at one end of the winding core part in an axial direction of a longitudinal axis of the winding core part, wherein the flange part includes first and second grooves, the first groove extends (1) from a first surface of the flange portion that is co-planar with a boundary between the winding core part and the flange part to a second surface of the flange portion that is configured to support a first terminal electrode and (2) obliquely to the longitudinal axis at a first angle relative to the longitudinal axis, the second groove extends (1) from the first surface of the flange portion that is co-planar with the boundary between the winding core part and the flange part to a third surface of the flange portion that is configured to support a second terminal electrode and (2) obliquely to the longitudinal axis at a second angle relative to the longitudinal axis, and the first and second angle are different, a step surface is around the boundary between the flange part and the winding core part, a first start tip of the first groove and a second start tip of the second groove are at different positions along a periphery of the step surface, at least a part of the step surface is inside an outermost surface of the flange part facing the winding part, and the first start tip and the second start tip are inside the outermost surface of the flange part.

* * * * *